US010035043B2

(12) United States Patent
Hogge et al.

(10) Patent No.: US 10,035,043 B2
(45) Date of Patent: Jul. 31, 2018

(54) GOLF BALL INCORPORATING HIGHLY CROSSLINKED THERMOSET FLUORESCENT MICROSPHERES AND METHODS OF MAKING SAME

(71) Applicant: Acushnet Company, Fairhaven, MA (US)

(72) Inventors: Matthew F. Hogge, Plymouth, MA (US); Peter L. Serdahl, New Bedford, MA (US); Scott Cooper, East Freetown, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/379,762

(22) Filed: Dec. 15, 2016

(65) Prior Publication Data

US 2018/0169478 A1 Jun. 21, 2018

(51) Int. Cl.
*A63B 37/00* (2006.01)
*A63B 45/00* (2006.01)

(52) U.S. Cl.
CPC ..... *A63B 37/0024* (2013.01); *A63B 37/0033* (2013.01); *A63B 37/0064* (2013.01); *A63B 37/0074* (2013.01); *A63B 45/00* (2013.01)

(58) Field of Classification Search
CPC ..... A63B 37/0024; A63B 37/0023
See application file for complete search history.

(56) References Cited

U.S. PATENT DOCUMENTS

| | | | |
|---|---|---|---|
| 6,083,119 | A | 7/2000 | Sullivan et al. |
| 6,395,861 | B1 | 5/2002 | Kennedy, III |
| 6,506,851 | B2 | 1/2003 | Wu |
| 6,528,578 | B2 | 3/2003 | Wu |
| 6,610,812 | B1 | 8/2003 | Wu et al. |
| 6,939,939 | B2 | 9/2005 | Slagel et al. |
| 7,148,278 | B2 | 12/2006 | Bulpett et al. |
| 7,207,905 | B2 | 4/2007 | Aoyama |
| 7,410,429 | B1 | 8/2008 | Bulpett et al. |
| 7,537,530 | B2 | 5/2009 | Bulpett et al. |
| 7,648,428 | B2 | 1/2010 | Nagasawa |
| 7,678,877 | B2 | 3/2010 | Yang et al. |
| 7,705,075 | B2 | 4/2010 | Kumar et al. |
| 7,705,176 | B2 | 4/2010 | Cholli et al. |
| 7,705,185 | B2 | 4/2010 | Kumar et al. |
| 7,767,853 | B2 | 8/2010 | Cholli et al. |
| 7,799,948 | B2 | 9/2010 | Kumar et al. |
| 7,902,317 | B2 | 3/2011 | Kumar et al. |
| 7,923,587 | B2 | 4/2011 | Cholli |
| 7,956,153 | B2 | 6/2011 | Cholli et al. |
| 7,999,019 | B2 | 8/2011 | Nakamura et al. |
| 8,008,423 | B2 | 8/2011 | Kumar et al. |
| 8,039,673 | B2 | 10/2011 | Cholli et al. |
| 8,080,689 | B2 | 12/2011 | Kumar et al. |
| 8,242,230 | B2 | 8/2012 | Cholli et al. |
| 8,252,884 | B2 | 8/2012 | Kumar et al. |
| 8,481,670 | B2 | 7/2013 | Kumar et al. |
| 8,551,279 | B2 | 10/2013 | Johnson et al. |
| 8,598,382 | B2 | 12/2013 | Cholli et al. |
| 8,691,933 | B2 | 4/2014 | Kumar et al. |
| 8,710,266 | B2 | 4/2014 | Kumar et al. |
| 8,846,847 | B2 | 9/2014 | Cholli et al. |
| 8,927,472 | B2 | 1/2015 | Cholli et al. |
| 8,956,730 | B2 | 2/2015 | Uprety et al. |
| 8,979,669 | B2 | 3/2015 | Greaney et al. |
| 9,193,675 | B2 | 11/2015 | Cholli et al. |
| 9,388,120 | B2 | 7/2016 | Kumar et al. |
| 2004/0018895 | A1* | 1/2004 | Bulpett ..... A63B 37/0003 473/378 |
| 2007/0110954 | A1* | 5/2007 | Whitehead ..... B60R 13/00 428/122 |
| 2008/0071016 | A1 | 3/2008 | Boettcher et al. |
| 2011/0224020 | A1* | 9/2011 | Tachibana ..... A63B 37/0003 473/373 |
| 2012/0100935 | A1 | 4/2012 | Michalewich et al. |
| 2012/0286449 | A1* | 11/2012 | Michalewich ..... A63B 37/0031 264/279 |

FOREIGN PATENT DOCUMENTS

| | | |
|---|---|---|
| DE | 3725926 | 2/1989 |
| DE | 4406024 | 8/1995 |
| EP | 31302 | 7/1981 |
| EP | 434618 | 6/1991 |
| EP | 707002 | 4/1996 |
| GB | 2319035 | 5/1998 |
| GB | 2361005 | 10/2001 |

OTHER PUBLICATIONS

U.S. Appl. No. 13/534,264, to Michaelwich, et al., filed Jun. 27, 2012.

* cited by examiner

*Primary Examiner* — John E Simms, Jr.
(74) *Attorney, Agent, or Firm* — Margaret C. Barker

(57) ABSTRACT

A golf ball comprising at least one layer consisting of a color-stable composition comprising a color concentrate composition comprising a carrier resin, at least one backer pigment and a plurality of highly crosslinked thermoset fluorescent microspheres having a hue that is substantially similar to a hue created by the at least one backer pigment. Each highly crosslinked thermoset fluorescent microsphere may be substantially spherical. Each highly crosslinked thermoset fluorescent microsphere may have a diameter of from about 0.5 micron to about 2.0 microns. The carrier resin may be an ionomer. The color-stable composition may comprise a mixture of the color concentrate composition and a polymer composition, wherein the polymer composition may be an ionomer composition.

19 Claims, No Drawings

GOLF BALL INCORPORATING HIGHLY CROSSLINKED THERMOSET FLUORESCENT MICROSPHERES AND METHODS OF MAKING SAME

FIELD OF THE INVENTION

Golf balls incorporating durable polymer compositions that can provide long term protection against weathering without compromising desirable golf ball properties.

BACKGROUND OF THE INVENTION

Conventional golf balls can be divided into two general classes: solid and wound. Solid golf balls include one-piece, two-piece (i.e., single layer core and single layer cover), and multi-layer (i.e., solid core of one or more layers and/or a cover of one or more layers) golf balls. Wound golf balls typically include a solid, hollow, or fluid-filled center, surrounded by a tensioned elastomeric material, and a cover.

Examples of golf ball materials range from rubber materials, such as balata, styrene butadiene, polybutadiene, or polyisoprene, to thermoplastic or thermoset resins such as ionomers, polyolefins, polyamides, polyesters, polyurethanes, polyureas and/or polyurethane/polyurea hybrids, and blends thereof. Typically, outer layers are formed about the spherical outer surface of an innermost golf ball layer via compression molding, casting, or injection molding.

From the perspective of a golf ball manufacturer, it is desirable to have materials exhibiting a wide range of properties, such as resilience, durability, spin, and "feel," because this enables the manufacturer to make and sell golf balls suited to differing levels of ability and/or preferences. In this regard, playing characteristics of golf balls, such as spin, feel, CoR and compression can be tailored by varying the properties of the golf ball materials and/or adding additional golf ball layers such as at least one intermediate layer disposed between the cover and the core. Intermediate layers can be of solid construction, and have also been formed of a tensioned elastomeric winding. The difference in play characteristics resulting from these different types of constructions can be quite significant.

Unfortunately, golf ball polymer compositions can begin to deteriorate as early as during golf ball manufacture due to the processing conditions under which golf balls are typically made. Deterioration then continues as the material weathers when exposed to environmental conditions such as sunlight (UV light/rays) on the course. UV light/rays can initiate deteriorating photochemical processes in golf ball polymers containing UV absorbent groups or impurities. Weathering impacts not only the golf ball's appearance but its durability, including creating poor adhesion between adjacent layers and reducing impact strength of outermost surfaces.

Golf ball manufacturers tend to incorporate coloring agents such as titanium dioxide ($TiO_2$) in ionomers in order to impart a suitable color to the material which would otherwise generally be colorless. UV light can deteriorate inner or outer surface properties in colored ionomers. In rubber materials, destructive peroxy radicals are known to form during the rubber degradation process, and aromatic isocyanate-based polyurethane and polyurea polymers are particularly vulnerable to weathering from exposure to UV light rays since aromatic structures are inherently unstable and may be found in the reaction product.

Golf ball manufacturers typically address these problems by incorporating stabilizers in golf ball polymer compositions. Conventional antidegradants including UV absorbers, radical scavengers, peroxide decomposers, and quenchers can afford some protection to polymers against the harmful effects of degradation. Each of these classes of antidegradent plays a unique role in protecting a golf ball polymer from a specific cause of deterioration.

For example, UV absorbers are generally helpful to absorb or filter damaging light before a chromosphore (the part of a molecule responsible for its color) can be formed. UV absorbers can absorb harmful UV light and transform it into harmless heat. Examples include 2-(2-hydroxyphenyl)-benzotriazoles, 2-hydroxy-benzophenones, hydroxyphenyl-s-triazines, and oxalanilides, each of which are characterized by a specific absorption and transmission spectrum. A suitable UV absorber should absorb UV light better and faster than the polymer it is added to protect against, and dissipate absorbed energy before undesirable side reactions occur.

In turn, peroxide decomposers decompose peroxides into non-radical and stable products, and quenchers accept energy from excited polymer molecules through an energy transfer mechanism and deactivate chromosphores before the excited states can undergo a reaction resulting in degradation. On the other hand, free radical scavengers can trap radicals before undesirable reactions (polymer degradation) takes place. Suitable free radical scavengers should be capable of trapping radicals and interrupting the chain reaction that can occur in a polymer when an excited chromophore decomposes to form radicals. Free radicals typically (i) react with the polymer and/or atmospheric oxygen, or (ii) remove a hydrogen atom from the polymer thereby initiating a free radical reaction. Examples of conventional free radical scavengers include sterically hindered amines (HALS) and antioxidants. HALS are typically derivatives of 2,2,6,6-tetraamethylpiperidine and react with a free radical to give the stable nitroxyl radical.

Meanwhile, antioxidants can potentially prolong the service life of a broad range of polymers. Common primary antioxidants include amines and phenolic antioxidants, which are chain terminating. Phenolic antioxidants are often used to inhibit thermo-oxidation at higher processing temperatures (e.g., ≥150° C.) and catalyze formation of a stable phenoxy radical to terminate free radical chain reactions initiated in a polymer. Secondary antioxidants, e.g., phosphites, can decompose peroxide.

Given these different roles, "stabilizer packages" comprised of antidegradants from several different classes are often included in golf ball polymer compositions. One drawback with conventional stabilizers, however, is their tendency to shift or migrate within a polymeric material over time, thereby limiting the degree and shortening the lifespan of protection provided by the stabilizer against weathering—which negatively impacts golf ball durability. This shift can be inward toward/into an inner adjacent golf ball layer or outward toward the layer's surface and/or an adjacent outer layer.

Thus, there is a need for golf balls possessing longer term protection against weathering that may be produced cost effectively within existing golf ball manufacturing processes. Golf balls of the present invention and method of making same address and solve this need.

SUMMARY OF THE INVENTION

Advantageously, a golf ball of the invention contains at least one layer of polymer material containing a non-migratory plurality of highly crosslinked thermoset fluorescent microspheres which may be dispersed throughout and remain fixed within a polymer matrix and provide long term protection against weathering without the problems caused by conventional migratory stabilizers. In one embodiment, a golf ball of the invention comprises at least one layer consisting of a color-stable composition comprising a color concentrate composition comprising: a carrier resin; at least one backer pigment; and a plurality of highly crosslinked thermoset fluorescent microspheres having a hue that is substantially similar to a hue of the at least one backer pigment.

Each highly crosslinked thermoset fluorescent microsphere may be substantially spherical, and have a diameter of from about 0.5 micron to about 2.0 microns. In a particular embodiment, the carrier resin is an ionomer. In a specific embodiment, the ratio of carrier resin to plurality of highly crosslinked thermoset fluorescent microspheres is about 1.0:0.20 to 1.0:3.5.

The backer pigment may comprise a mixture of titanium dioxide and at least one backer pigment having a hue other than white. The weight ratio of backer pigment to plurality of highly crosslinked thermoset fluorescent microspheres may be about 1.0:0.5 to 1.0:2.0.

In a particular embodiment, the color-stable composition comprises a mixture of the color concentrate composition and a polymer composition. In a specific embodiment, the polymer composition is an ionomer composition.

In one embodiment, the mixture comprises about 95 to 98 parts by weight of a blend of the carrier resin and the polymer composition, about 0.2 to 1.0 parts by weight of at least one backer pigment, and about 0.1 to 2.0 parts by weight of plurality of highly crosslinked thermoset fluorescent microspheres, based on the total weight of the color-stable composition.

The mixture may further comprise about 0.1 to 1.0 parts by weight of at least one ultra violet (UV) absorber, about 0.1 to 1.0 parts by weight of at least one hindered amine light stabilizer (HALS), or a combination thereof.

For example, the at least one UV absorber selected from the group consisting of triazines, benzoxazinones, benzotriazoles, benzophenones, benzoates, formamidines, cinnamates/propenoates, aromatic propanediones, benzimidazoles, cycloaliphatic ketones, formanilides (including oxamides), cyanoacrylates, benzopyranones, salicylates, substituted acrylonitriles, or combinations thereof. In one embodiment, the at least one HALS is a derivative of 2,2,6,6-tetraamethylpiperidine.

In a specific embodiment, the at least one layer is a cover layer having a thickness of from about 0.030 inches to about 0.085 inches and is disposed about a polybutadiene-based core having a diameter of from about 1.5 inches to about 1.620 inches.

The invention also relates to a method of making a golf ball of the invention comprising: providing a subassembly; providing a color-stable composition comprising a color concentrate composition comprising: a carrier resin, at least one backer pigment, and a plurality of highly crosslinked thermoset fluorescent microspheres having a combinatorial hue that is substantially similar to a hue of the at least one backer pigment; and forming at least one layer consisting of the color-stable composition about the subassembly.

DETAILED DESCRIPTION

Golf balls of the invention incorporate at least one layer of polymer material containing a non-migratory plurality of highly crosslinked thermoset fluorescent microspheres that remains substantially dispersed and fixed throughout a polymer matrix of the polymer material and provide long term protection against deterioration without the problems caused by conventional migratory stabilizers. Meanwhile, the highly crosslinked thermoset fluorescent microspheres are capable of absorbing both visible and nonvisible electromagnetic radiations and releasing them quickly as energy of a target wavelength, thereby producing a vivid color appearance.

Specifically, in one embodiment, a golf ball of the invention comprises at least one layer consisting of a color-stable composition comprising a color concentrate composition comprising: a carrier resin; at least one backer pigment; and a plurality of highly crosslinked thermoset fluorescent microspheres having a hue that is substantially similar to a hue of the at least one backer pigment.

A starting hue may be established for the material of the at least one layer by selecting at least one traditional pigment. In a particular embodiment, a stable red pigment may be added or otherwise combined with $TiO_2$ (white pigment) in an amount sufficient to achieve a target predominant hue.

Then, a fluorescent color can be built into the color concentrate by incorporating the plurality of highly crosslinked thermoset fluorescent microspheres having a hue that is substantially similar to a hue of the at least one backer pigment to provide the strong vivid fluorescent color. In particular embodiments, the predominant hue of the plurality of highly crosslinked thermoset fluorescent microspheres is coordinated with the hue of the backer pigment to create a combinatorial hue that remains vivid and vibrant due at least in part to the long term protection against weathering which the plurality of highly crosslinked thermoset fluorescent microspheres provide to the color-stable composition.

In some cases, traditional dye-on-carrier fluorescent pigments may be added to the formulation as well. However, ideally, dye-type pigments should be added in the least amount sufficient to create the target predominant hue, since the plurality of highly crosslinked thermoset fluorescent microspheres are substantially non-migratory and more color stable. In some embodiments, traditional stabilizers may also be added with the plurality of highly crosslinked thermoset fluorescent microspheres.

Each highly crosslinked thermoset fluorescent microsphere may be substantially spherical, and have a diameter of from about 0.5 micron to about 2.0 microns, or from about 0.5 micron to about 1.5 microns, or from about 0.5 micron to about 1.0 microns, or from about 1.0 micron to about 2.0 microns, or from about 1.0 micron to about 1.5 microns, or from about 1.5 micron to about 2.0 microns.

The backer pigment may comprise a mixture of titanium dioxide and at least one backer pigment having a hue other than white in order achieve the target hue. The weight ratio of backer pigment to plurality of highly crosslinked thermoset fluorescent microspheres may be about 1.0:0.5 to 1.0:2.0.

In a particular embodiment, the carrier resin is an ionomer. In a specific embodiment, the ratio of carrier resin to plurality of highly crosslinked thermoset fluorescent microspheres is about 1.0:0.20 to 1.0:3.5.

In one embodiment, the color-stable composition comprises a mixture of the color concentrate composition and a polymer composition. And in a particular such embodiment like golf ball EX. 1 of TABLE I, the carrier resin and the polymer composition may both be ionomers which form a blend when combined. In this embodiment, the mixture may comprise about 95 to 98 parts by weight of blend of the carrier resin and the polymer composition, about 0.2 to 1.0 parts by weight of at least one backer pigment, and about 0.1 to 2.0 parts by weight of plurality of highly crosslinked thermoset fluorescent microspheres, based on the total weight of the color-stable composition.

However, embodiments are also envisioned wherein one or both of the carrier resin and/or polymer composition may be a golf ball resin other than an ionomer, such as a polyurethane, for example, or a polyurea and polyurethane. Embodiments are likewise envisioned wherein the color-stable composition may include the color concentrate composition component only and without the polymer composition portion or component.

The color-stable composition may further comprise about 0.1 to 1.0 parts by weight of at least one ultra violet (UV) absorber, about 0.1 to 1.0 parts by weight of at least one hindered amine light stabilizer (HALS), or a combination thereof.

For example, the at least one UV absorber selected from the group consisting of triazines, benzoxazinones, benzotriazoles, benzophenones, benzoates, formamidines, cinnamates/propenoates, aromatic propanediones, benzimidazoles, cycloaliphatic ketones, formanilides (including oxamides), cyanoacrylates, benzopyranones, salicylates, substituted acrylonitriles, or combinations thereof. In one embodiment, the at least one HALS is a derivative of 2,2,6,6-tetraamethylpiperidine.

In a specific embodiment, the at least one layer is a cover layer having a thickness of from about 0.030 inches to about 0.085 inches and is disposed about a polybutadiene-based core having a diameter of from about 1.5 inches to about 1.620 inches.

The invention also relates to a method of making a golf ball of the invention comprising: providing a subassembly; providing a color-stable composition comprising a color concentrate composition comprising: a carrier resin, at least one backer pigment, and a plurality of highly crosslinked thermoset fluorescent microspheres having a combinatorial hue that is substantially similar to a hue of the at least one backer pigment; and forming at least one layer consisting of the color-stable composition about the subassembly.

A golf ball of the invention incorporating at least one layer can be made cost effectively within conventional existing golf ball manufacturing processes by combining the color concentrate composition and ionomer composition, wherein color concentrate composition portion of the layer formula uniquely contains a plurality of highly crosslinked thermoset fluorescent microspheres. Admixing the color concentrate composition and ionomer composition is done because colorants, especially those having a relatively small particle size, often do not readily disperse throughout large batches of ionomers and admixing can achieve a more uniform dispersion of the coloring agent throughout the resulting ionomeric layer wherein an ionomeric composition component is included in both the color concentrate composition and ionomer composition portions of the layer formula.

The plurality of highly crosslinked thermoset fluorescent microspheres can be mixed with the carrier ionomer resin and at least one backer pigment in a twin screw extruder, followed by pelletizing of the resulting extrudate, thereby forming pellets of color concentrate composition. The plurality of highly crosslinked thermoset fluorescent microspheres preferably have a hue that is substantially similar to a hue created by the at least one backer pigment.

The color concentrate composition pellets may then be admixed with pellets of ionomer composition to form the color-stable composition for forming the at least one layer. Mixing or blending of the color concentrate composition and ionomer composition may be accomplished by methods familiar to those in the polymer blending art, for example, with a two roll mill, a Banbury mixer or a single or twin-screw extruder. The single screw extruder may optionally have a grooved barrel wall, comprise a barrier screw or be of a shortened screw design. The twin screw extruder may be of the counter-rotating non-intermeshing, co-rotating non-intermeshing, counter-rotating fully intermeshing or co-rotating fully intermeshing type.

The mixture of color concentrate composition and ionomer polymer composition can then be placed into a hopper which is used to feed the heated barrel of an injection molding machine. Further mixing is accomplished by a screw within the heated injection molder barrel. The injection molding machine is used either to make preformed half-shells, subsequently compression molded over a core, e.g., in a ball mold, or to directly mold the cover about the core, e.g., in a retractable-pin mold. Such molds and machines are conventional.

The resulting layer therefore contains an ionomer component that is a mixture or blend of the carrier ionomer resin and the ionomer composition. After molding, golf balls comprising the golf ball compositions of the invention can be finished by buffing, painting and stamping.

Without being bound to a particular theory, in a finished layer of color-stable composition, synergistically, the plurality of highly crosslinked thermoset fluorescent microspheres are substantially evenly dispersed throughout and remain substantially fixed within a polymer matrix of polymer, with interactions between each highly crosslinked thermoset fluorescent microsphere and the polymer thereby creating a strong and stationary network providing long term protection throughout the entire layer against deterioration. The plurality of highly crosslinked thermoset fluorescent microspheres advantageously do not substantially migrate, much less toward the layer surface or into an adjacent layer over time, in contrast with conventional antidegradents which are migratory to a damaging extent.

Accordingly, a golf ball of the invention incorporating at least one layer of color-stable composition solves the problems of prior golf balls wherein adhesion problems can result from conventional generally migratory stabilizers which are included in the layer formulation either to prevent deterioration during manufacturing or later when the golf ball is exposed to UV rays on the course.

In a golf ball of the invention, the carrier ionomer resin may advantageously comprise any known ionomer or combination of ionomer types, some of which are detailed further below. Additional materials conventionally included in golf ball compositions may be added to the compositions of the invention to enhance the formation of golf ball layers, including covers. These additional materials include, but are not limited to, ultraviolet light stabilizers and/or absorbers, dyes, pigments, fluorescent pigments, optical brighteners, processing aids, glass fibers, inorganic particles, metal particles, such as metal flakes, metal powders and mixtures thereof, and other conventional additives.

Antioxidants, stabilizers, softening agents, plasticizers, including internal and external plasticizers, impact modifiers, toughening agents, foaming agents, fillers, reinforcing materials and compatibilizers can also be added to any composition of the invention. All of these materials, which are well known in the art, are added for their usual purpose in typical amounts.

The at least one layer may be any golf ball layer and is particularly suitable as an outer layer such as a cover layer.

The subassembly can be a single core, a dual core, a core and intermediate layer, or even a core, intermediate layer and inner cover layer.

A golf ball of the invention incorporating at least one layer of color-stable color composition exhibits excellent and superior long term resistance to weathering as demonstrated in TABLE I below. In this regard, the weathering of at least three inventive golf balls of group EX. 1 was compared with the weathering of at least three golf balls in each of five comparative groups Comp. EX. 1, Comp. EX. 2, Comp. EX. 3, Comp. EX. 4, and Comp. EX. 5.

Inventive golf balls EX. 1 all incorporated a single polybutadiene rubber blend core having a diameter of about 1.56 inches surrounded by a cover having a thickness of about 0.060 inches and consisting of a color-stable polymer composition consisting of about 8 parts of a Surlyn® polymer composition (Surlyn®9945/Surlyn®9910/Surlyn®8940) to about 1 part color concentrate composition having the following ingredients (expressed in parts by weight based on the total weight of color concentrate composition): Surlyn Carrier Resin (Surlyn®8945) (58.96); DuPont TiPure R-960 (7.5); Spectra Dyestuffs Neelasol FL Red KR (0.15); BMS-PK411 Brilliant Microspheres Pink (13.5); BMS-CE412 Brilliant Microspheres Cerise (1.5); BASF Cinquasia Red L4330 (0.45); BASF Chimasorb 81 (8.97); BASF Tinuvin 770 DF (8.97). The traditional pigment (DuPont TiPure R-960, Spectra Dyestuffs Neelasol FL Red KR and BASF Cinquasia Red L4330) and plurality of highly crosslinked thermoset fluorescent microspheres were coordinated such that when fluorescence degrades, the overall targeted hue of the golf ball is maintained.

Prior to weathering, initial values for color coordinates L*, a*, b*, C* and h° were ascertained for all golf balls of every given group EX. 1, Comp. EX. 1, Comp. EX. 2, Comp. EX. 3, Comp. EX. 4, and Comp. EX. 5 via colorimetry. Within each group, the values of like coordinates were averaged, and resulting average values are recorded in TABLE I at respective lines "Time (0)" for each group.

Subsequently, all golf balls were subjected to accelerated weathering for 6 hours (hrs.), 12 hrs., 24 hrs., 36 hrs., and 72 hrs. via Xenon tester model Q-SUN Xe-3HS, with the values for color coordinates L*, a*, b*, C* and h° being ascertained for all golf balls at each of these time intervals via colorimetry. Once again, within each group, the values of like coordinates were averaged, and resulting average values are recorded in TABLE I at respective lines Time (6), Time (12), Time (24), Time (36), and Time (72) (hours) for each group.

Consequently, average deltas (change in) lightness (DL*cmc), chroma (DC*cmc), hue (DH*cmc) and "distance" between two colors (DE*cmc) could then be derived between time intervals Time (0), Time (6), Time (12), Time (24), Time (36), and Time (72) for each golf ball group EX. 1, Comp. EX. 1, Comp. EX. 2, Comp. EX. 3, Comp. EX. 4, and Comp. EX. 5 using the relevant well known equations in the CIELAB color space and are reported in TABLE I as follows:

TABLE I

| GOLF BALL | Time (hr.) | L* | a* | b* | C* | h° | DL* cmc | DC* cmc | DH* cmc | DE* cmc |
|---|---|---|---|---|---|---|---|---|---|---|
| Inventive | 0 | 69.65 | 50.98 | −3.45 | 51.10 | 356.13 | — | — | — | — |
| Golf ball | 6 | 69.67 | 47.16 | −0.62 | 47.16 | 359.25 | 0.01 | −1.52 | 1.47 | 2.11 |
| EX. 1 | 12 | 70.89 | 45.61 | −0.05 | 45.61 | 359.93 | 0.49 | −2.12 | 1.76 | 2.80 |
| | 24 | 71.42 | 44.48 | 0.26 | 44.48 | 0.34 | 0.69 | −2.55 | 1.92 | 3.27 |
| | 36 | 71.74 | 43.75 | 1.38 | 43.77 | 1.80 | 0.82 | −2.83 | 2.57 | 3.91 |
| | 72 | 72.38 | 39.58 | 1.86 | 39.62 | 2.69 | 1.07 | −4.43 | 2.83 | 5.36 |
| Golf ball | 0 | 85.19 | 14.86 | −6.69 | 16.30 | 335.74 | — | — | — | — |
| Comp. | 6 | 85.12 | 14.36 | −5.33 | 15.32 | 339.63 | −0.03 | −0.65 | 0.99 | 1.18 |
| EX. 1 | 12 | 85.11 | 14.18 | −3.85 | 14.70 | 344.80 | −0.03 | −1.07 | 2.26 | 2.50 |
| Pinn. | 24 | 84.94 | 13.43 | −2.10 | 14.60 | 351.10 | −0.09 | −1.81 | 3.67 | 4.09 |
| Soft | 36 | 84.92 | 13.48 | −0.95 | 13.51 | 355.98 | −0.10 | −1.86 | 4.81 | 5.16 |
| Pink | 72 | 84.65 | 12.92 | −0.66 | 12.94 | 357.10 | −0.19 | −2.25 | 4.97 | 5.45 |
| Golf ball | 0 | 64.88 | 66.02 | −6.46 | 66.33 | 354.41 | — | — | — | — |
| Comp. | 6 | 65.17 | 62.41 | −2.25 | 62.45 | 357.94 | 0.12 | −1.34 | 1.93 | 2.35 |
| EX. 2 | 12 | 66.88 | 61.69 | 2.15 | 61.72 | 2.00 | 0.81 | −1.59 | 4.12 | 4.49 |
| Srixon | 24 | 69.13 | 57.70 | 5.11 | 57.93 | 5.06 | 1.72 | −2.90 | 5.60 | 6.53 |
| Pink | 36 | 70.29 | 55.68 | 5.82 | 55.98 | 5.97 | 2.18 | −3.57 | 5.97 | 7.29 |
| Lady | 72 | 73.60 | 48.59 | 7.31 | 49.13 | 8.55 | 3.52 | −5.93 | 6.84 | 9.71 |
| Golf ball | 0 | 73.73 | 54.31 | −6.71 | 54.72 | 352.96 | — | — | — | — |
| Comp. | 6 | 74.76 | 49.38 | −4.88 | 49.62 | 354.36 | 0.40 | −1.91 | 0.67 | 2.06 |
| EX. 3 | 12 | 76.98 | 45.00 | −2.68 | 45.08 | 356.60 | 1.24 | −3.61 | 1.65 | 4.16 |
| Bridge- | 24 | 77.48 | 40.57 | 0.49 | 40.57 | 0.70 | 1.43 | −5.30 | 3.34 | 6.42 |
| stone | 36 | 78.58 | 38.11 | 1.58 | 38.14 | 2.38 | 1.85 | −6.21 | 3.94 | 7.58 |
| PinkLady | 72 | 82.26 | 29.05 | 4.69 | 29.42 | 9.17 | 3.35 | −9.47 | 5.94 | 11.64 |
| Golf ball | 0 | 76.10 | 73.06 | 11.44 | 73.95 | 8.90 | — | — | — | — |
| Comp. | 6 | 71.64 | 58.46 | 5.75 | 58.74 | 5.61 | −1.67 | −5.01 | −1.92 | 5.62 |
| EX. 4 | 12 | 73.82 | 51.06 | 8.09 | 51.70 | 9.00 | −0.86 | −7.33 | 0.06 | 7.38 |
| Callaway | 24 | 75.24 | 46.48 | 8.38 | 47.23 | 10.22 | −0.32 | −8.81 | 0.70 | 8.84 |
| SS Pink | 36 | 76.99 | 45.01 | 9.74 | 46.05 | 12.21 | 0.34 | −9.20 | 1.72 | 9.36 |
| | 72 | 80.45 | 34.61 | 10.56 | 36.18 | 16.97 | 1.64 | −12.45 | 3.70 | 13.09 |
| Golf ball | 0 | 74.43 | 73.29 | 5.60 | 73.50 | 4.37 | — | — | — | — |
| Comp. | 6 | 71.91 | 66.33 | 5.54 | 66.56 | 4.78 | −0.95 | −2.29 | 0.25 | 2.50 |
| EX. 5 | 12 | 72.77 | 62.35 | 7.19 | 62.76 | 6.58 | −0.63 | −3.55 | 1.29 | 3.83 |
| Callaway | 24 | 73.53 | 59.59 | 7.40 | 60.05 | 7.08 | −0.34 | −4.45 | 1.55 | 4.72 |
| Solaire | 36 | 74.14 | 57.19 | 7.34 | 57.66 | 7.31 | −0.11 | −5.23 | 1.65 | 5.49 |
| Pink | 72 | 76.33 | 52.01 | 8.90 | 52.77 | 9.71 | 0.72 | −6.85 | 2.86 | 7.46 |

Comparing the results relating to inventive golf balls EX. 1 in TABLE I with the results relating to comparative golf ball groups Comp. EX. 1, Comp. EX. 2, Comp. EX. 3, Comp. EX. 4, and Comp. EX. 5, at least the following is notable and demonstrates that long term weathering was desirably better in inventive golf balls of group EX. 1 than in any of the comparative golf balls. Specifically, in inventive golf ball group EX. 1, the changes in DH*cmc and DE*cmc from T(0) to T(72) hours were 2.83 and 5.36, respectively, whereas in each comparative golf ball group Comp. EX. 1, Comp. EX. 2, Comp. EX. 3, Comp. EX. 4, and Comp. EX. 5, the changes in DH*cmc and DE*cmc from T(0) to T(72) hours were 4.97 and 5.45; 6.84 and 9.71; 5.94 and 11.64; 3.70 and 13.09; as well as 2.86 and 7.46, respectively. This translates to the comparative golf balls having overall worse/poorer weathering through hour 72 by the following factors (i) DH*cmc by factors of about: 1.75 (Comp. EX. 1); 2.42 (Comp. EX. 2); 2.10 (Comp. EX. 3); 1.31 (Comp. EX. 4); and 1.01 (Comp. EX. 5); and (ii) DE*cmc by factors of about: 1.02 (Comp. EX. 1); 1.81 (Comp. EX. 2); 2.17 (Comp. EX. 3); 2.44 (Comp. EX. 4); and 1.39 (Comp. EX. 5).

Additionally, in inventive golf ball group EX. 1, the change in DH*cmc and DE*cmc from hours T(6) to T(72) were 1.36 and 3.35, respectively, whereas in each comparative golf ball group Comp. EX. 1, Comp. EX. 2, Comp. EX. 3, Comp. EX. 4, and Comp. EX. 5, the changes in DH*cmc and DE*cmc from hours T(6) to T(72) were 3.98 and 4.27; 4.91 and 7.36; 5.27 and 9.58; 5.62 and 7.47; as well as 2.61 and 4.96, respectively. This translates to the comparative golf balls having overall worse/poorer weathering from hours T(6) to T(72) by the following factors: (i) DH*cmc by factors of about: 2.93 (Comp. EX. 1); 3.61 (Comp. EX. 2); 3.88 (Comp. EX. 3); 4.13 (Comp. EX. 4); and 1.92 (Comp. EX. 5); and (ii) DE*cmc by factors of about: 1.31 (Comp. EX. 1); 2.65 (Comp. EX. 2); 2.95 (Comp. EX. 3); 2.30 (Comp. EX. 4); and 1.92 (Comp. EX. 5).

In fact, inventive golf balls EX 1 display superior weathering as early as the first measurement at hour T(6) following the initial color coordinate measurements at T(0), compared with weathering of comparative golf balls Comp. EX. 2, Comp. EX. 4, and Comp. EX. 5.

While comparative golf balls Comp. EX. 1 display a lower average DH*cmc (0.99) than that of inventive golf balls EX. 1 (1.47) at time T(6) hours, the DH*cmc of Comp. EX. 1 has become 1.28 times higher than that of golf balls EX. 1 by time T(12) hours. And meanwhile, golf balls Comp. EX. 1 may have a lower average DE*cmc than that of inventive golf balls EX. 1 up to time T(12) hours, but this changes by time T(24) hours and DE*cmc of Comp. EX. 1 has become 1.25 times higher than that of golf balls EX. 1.

Comparative golf balls Comp. EX. 3 have a lower average DH*cmc (1.65) than that of inventive golf balls EX. 1 (1.76) through time T(12) hours, but DH*cmc of Comp. EX. 1 becomes 1.74 times higher than that of golf balls EX. 1 by time T(24) hours. And golf balls Comp. EX. 3 have a lower average DE*cmc than that of inventive golf balls EX. 1 at time T(6) hours, but a 1.49 times higher value than that of golf balls EX. 1 by time T(12) hours.

Accordingly, the results discussed herein in connection with accompanying TABLE I demonstrate that inventive golf balls EX. 1 incorporating a cover of color-stable color composition exhibit excellent and superior long term resistance to weathering compared with several competitive golf balls Comp. EX. 1, Comp. EX. 2, Comp. EX. 3, Comp. EX. 4, and Comp. EX. 5 that do not contain the color-stable color composition. Advantageously, in a finished layer of color-stable composition, the plurality of highly crosslinked thermoset fluorescent microspheres are substantially evenly dispersed throughout and remain substantially fixed within a polymer matrix of polymer, with interactions between each highly crosslinked thermoset fluorescent microsphere and the polymer thereby creating a strong and stationary network providing long term protection throughout the entire layer against deterioration. The plurality of highly crosslinked thermoset fluorescent microspheres do not migrate toward the layer surface or into an adjacent layer over time, in contrast with conventional antidegradents which are generally migratory at least to some extent.

Experimental golf ball Ex. 1 of TABLE I represents a particular golf ball of the invention wherein the carrier resin and polymer composition are both ionomers. In such embodiment, the carrier resin and polymer composition may be selected to target desired golf ball properties and one or both may be a reaction mixture of at least one acid copolymer, which may be a copolymer of an α-olefin, and at least one $C_{3-8}$ α, β-ethylenically unsaturated carboxylic acid. For example, the olefin may be ethylene or propylene, preferably ethylene (also referred to as ethylene acid copolymers). Such copolymers are referred to as E/X copolymers, where E is ethylene, and X is a α, β-ethylenically unsaturated carboxylic acid. The term "copolymer", as used herein, includes polymers having two types of monomers, those having three types of monomers, and those having more than three types of monomers.

Examples of suitable ethylene acid copolymers include but are not limited to ethylene/(meth)acrylic acid, ethylene/(meth)acrylic acid/maleic anhydride, ethylene/(meth)acrylic acid/maleic acid mono-ester, ethylene/maleic acid, ethylene/maleic acid mono-ester, ethylene/(meth)acrylic acid/n-butyl (meth)acrylate, ethylene/(meth)acrylic acid/iso-butyl (meth) acrylate, ethylene/(meth)acrylic acid/methyl (meth)acrylate, ethylene/(meth)acrylic acid/ethyl (meth)acrylate terpolymers, and the like.

Preferred α, β-ethylenically unsaturated mono- or dicarboxylic acids are (meth) acrylic acid, ethacrylic acid, maleic acid, crotonic acid, fumaric acid, itaconic acid. (Meth) acrylic acid is most preferred. As used herein, "(meth) acrylic acid" means methacrylic acid and/or acrylic acid. Likewise, "(meth) acrylate" means methacrylate and/or acrylate.

The ethylene acid copolymer is used in an amount of at least about 5% by weight based on total weight of carrier resin and/or polymer composition and is generally present in an amount of about 5% to about 100%, or an amount within a range having a lower limit of 5% or 10% or 20% or 30% or 40% or 50% and an upper limit of 55% or 60% or 70% or 80% or 90% or 95% or 100%. For example, in one embodiment, the concentration of ethylene acid copolymer may be about 40 to about 95 weight percent.

The amount of ethylene in the acid copolymer is typically at least 15 wt. %, or at least 25 wt. %, or at least 40 wt. %, or at least 60 wt. %, based on total weight of the copolymer. The amount of $C_3$ to $C_8$ α, β-ethylenically unsaturated mono- or dicarboxylic acid in the acid copolymer is typically from 1 wt. % to 40 wt. %, or from 5 wt. % to 30 wt. %, or from 5 wt. % to 25 wt. %, or from 10 wt. % to 20 wt. %, based on total weight of the copolymer.

When a softening monomer is included, such copolymers are referred to herein as E/X/Y-type copolymers, wherein E is ethylene; X is a $C_3$ to $C_8$ α, β-ethylenically unsaturated mono- or dicarboxylic acid; and Y is the softening monomer. The softening monomer is typically an alkyl (meth) acrylate, wherein the alkyl groups have from 1 to 8 carbon atoms. Preferred E/X/Y-type copolymers are those wherein X is (meth) acrylic acid and/or Y is selected from (meth) acrylate, n-butyl (meth) acrylate, isobutyl (meth) acrylate, methyl (meth) acrylate, and ethyl (meth) acrylate. More preferred E/X/Y-type copolymers are ethylene/(meth) acrylic acid/n-butyl acrylate, ethylene/(meth) acrylic acid/methyl acrylate, and ethylene/(meth) acrylic acid/ethyl acrylate. The amount of optional softening comonomer in the acid copolymer is typically from 0 wt. % to 50 wt. %, or from 5 wt. % to 40 wt. %, or from 10 wt. % to 35 wt. %, or from 20 wt. % to 30 wt. %, based on total weight of the copolymer.

"Low acid" and "high acid" carrier resin and/or polymer compositions, as well as blends of such ionomers, may be used. In general, low acid ionomers are considered to be those containing 16 wt. % or less of acid moieties, whereas high acid ionomers are considered to be those containing greater than 16 wt. % of acid moieties.

The acidic groups in the acid copolymer may be partially or totally neutralized with a cation source. Suitable cation sources include metal oxides and metal salts, organic amine compounds, ammonium, and combinations thereof. Examples of cation sources include metal oxides and metal salts, wherein the metal is lithium, sodium, potassium, magnesium, calcium, barium, lead, tin, zinc, aluminum, manganese, nickel, chromium, copper, or a combination thereof. The metal salts provide the cations capable of neutralizing (at varying levels) the carboxylic acids of the ethylene acid copolymer and fatty acids, if present, as discussed further below. These include, for example, the sulfate, carbonate, acetate, oxide, or hydroxide salts of lithium, sodium, potassium, magnesium, calcium, barium, lead, tin, zinc, aluminum, manganese, nickel, chromium, copper, or a combination thereof. Preferred metal salts are calcium and magnesium-based salts. High surface area cation sources such as micro and nano-scale particles are preferred. The amount of cation source used in the composition is readily determined based on desired level of neutralization.

For example, the acidic groups in the acid copolymer may be neutralized from about 10% to about 100% with the cation source. In a reaction mixture, wherein the acid groups are partially neutralized, the neutralization level is from about 10% to about 70%, or 20% to 60%, or 30 to 50%. Such reaction mixtures, containing acid groups neutralized to 70% or less, may be referred to as having relatively low neutralization levels.

On the other hand, the reaction mixture may contain acid groups that are highly or fully-neutralized. In these highly neutralized polymers (HNPs), the neutralization level is greater than 70%, or at least 80%, or at least 90%, or at least 100%. In another embodiment, an excess amount of neutralizing agent, that is, an amount greater than the stoichiometric amount needed to neutralize the acid groups, may be used. That is, the acid groups may be neutralized to 100% or greater, for example 110% or 120% or greater. In one embodiment, a high acid ethylene acid copolymer containing about 19 to 20 wt. % methacrylic or acrylic acid is neutralized with zinc and sodium cations to a 95% neutralization level.

In an embodiment wherein the carrier resin and/or polymer composition comprises a highly neutralized polymer or HNP, the acid polymer may be reacted with a sufficient amount of cation source, in the presence of an organic acid or salt thereof, such that at least about 80 percent, or at least about 90 percent, or at least about 95 percent, or about 100 percent, of all acid groups present are neutralized. In one embodiment, the cation source is present in an amount sufficient to neutralize, theoretically, greater than about 100 percent. For example, the cation source may be present in an amount sufficient to neutralize greater than about 110 percent. In another embodiment, the cation source is present in an amount sufficient to neutralize greater than about 200 percent of the acid groups. In still another embodiment, the cation source is present in an amount sufficient to neutralize greater than about 250 percent of all acid groups present.

In this aspect, the acid polymer can be reacted with the organic acid or salt thereof and the cation source simultaneously, or the acid polymer can be reacted with the organic acid or salt thereof prior to the addition of the cation source. For example, an ethylene α, β-ethylenically unsaturated carboxylic acid copolymer may be melt-blended with an organic acid or a salt of organic acid, and a sufficient amount of a cation source may be added to increase the level of neutralization of all the acid moieties (including those in the acid copolymer and in the organic acid) to greater than about 90 percent, or greater than about 100 percent. However, any method of neutralization available to those of ordinary skill in the art may also be suitably employed.

"Ionic plasticizers" such as organic acids or salts of organic acids, particularly fatty acids, may be added to the reaction mixture if needed. Such ionic plasticizers are used to make conventional ionomer composition more processable as described in Rajagopalan et al., U.S. Pat. No. 6,756,436, the disclosure of which is hereby incorporated by reference. In one embodiment, the reaction mixture, containing acid groups neutralized to 70% or less, does not include a fatty acid or salt thereof, or any other ionic plasticizer. In another embodiment, the reaction mixture, containing acid groups neutralized to greater than 70%, includes an ionic plasticizer, particularly a fatty acid or salt thereof.

For example, the ionic plasticizer, which is particularly effective at improving the processability of highly-neutralized ionomers, may be added in an amount of 10.0 to 50.0 pph.

The organic acids may be aliphatic, mono- or multifunctional (saturated, unsaturated, or multi-unsaturated) organic acids. Salts of these organic acids may also be employed. Suitable fatty acid salts include, for example, metal stearates, laureates, oleates, palmitates, pelargonates, and the like. Fatty acid salts such as zinc stearate, calcium stearate, magnesium stearate, barium stearate, and the like can be used. The salts of fatty acids are generally fatty acids neutralized with metal ions. The metal salts provide the cations capable of neutralizing (at varying levels) the carboxylic acid groups of the fatty acids. Examples include the sulfate, carbonate, acetate and hydroxide salts of metals such as barium, lithium, sodium, zinc, bismuth, chromium, cobalt, copper, potassium, strontium, titanium, tungsten, magnesium, cesium, iron, nickel, silver, aluminum, tin, or calcium, and blends thereof. It is preferred the organic acids and salts be relatively non-migratory (they do not bloom to the surface of the polymer under ambient temperatures) and non-volatile (they do not volatilize at temperatures required for melt-blending).

In addition to the fatty acids and salts of fatty acids discussed above, other suitable plasticizers include, for example, polyethylene glycols, waxes, bis-stearamides, minerals, and phthalates. In another embodiment, an amine or pyridine compound is used, often in addition to a metal cation. Suitable examples include, for example, ethylamine, methylamine, diethylamine, tert-butylamine, dodecylamine, and the like.

It also is recognized that the carrier resin and/or polymer composition may contain a blend of two or more ionomers. For example, the reaction mixture may contain a 50/50 wt. % blend of two different highly-neutralized ethylene/methacrylic acid copolymers. In another version, the reaction mixture may contain a blend of one or more ionomers and a maleic anhydride-grafted non-ionomeric polymer. The non-ionomeric polymer may be a metallocene-catalyzed polymer. In another version, the reaction mixture contains a blend of a highly-neutralized ethylene/methacrylic acid copolymer and a maleic anhydride-grafted metallocene-catalyzed polyethylene copolymer. In yet another version, the reaction mixture contains a material selected from the group consisting of highly-neutralized ionomers optionally blended with a maleic anhydride-grafted non-ionomeric polymer; polyester elastomers; polyamide elastomers; and combinations of two or more thereof.

The at least one layer also may, for example, be formed from a reaction mixture comprising a 70/15/15 blend of Surlyn® 8940/Surlyn® 9945/Surlyn® 9910; a 50/45/5 blend of Surlyn® 8940/Surlyn® 9650/Nucrel® 960; a 50/25/25 blend of Surlyn® 8940/Surlyn® 9650/Surlyn® 9910; a 50/50 blend of Surlyn® 8940/Surlyn® 9650; and/or a 50/50 blend of Surlyn® 8940 and Surlyn® 7940 also may be used. Surlyn® 8940 is an E/MAA copolymer in which the MAA acid groups have been partially neutralized with sodium ions. Surlyn® 9650 and Surlyn® 9910 are two different grades of E/MAA copolymer in which the MAA acid groups have been partially neutralized with zinc ions. Nucrel® 960 is an E/MAA copolymer resin nominally made with 15 wt. % methacrylic acid.

A golf ball layer that is formed from a blend of two or more ionomers can helps impart hardness to the ball. In one embodiment, the at least one layer is formed from a reaction mixture comprising a high acid ionomer. A particularly suitable high acid ionomer is Surlyn 8150® (DuPont). Surlyn 8150® is a copolymer of ethylene and methacrylic acid, having an acid content of 19 wt %, which is 45% neutralized with sodium. In another particular embodiment, the inner cover layer is formed from a composition comprising a high acid ionomer and a maleic anhydride-grafted non-ionomeric polymer. A particularly suitable maleic anhydride-grafted polymer is Fusabond 525D® (DuPont). Fusabond 525D® is a maleic anhydride-grafted, metallocene-catalyzed ethylene-butene copolymer having about 0.9 wt. % maleic anhydride grafted onto the copolymer. Another particularly suitable blend of high acid ionomer and maleic anhydride-grafted polymer is 84 wt. %/16 wt. % blend of Surlyn 8150® and Fusabond 525D®. Blends of high acid ionomers with maleic anhydride-grafted polymers are further disclosed, for example, in U.S. Pat. Nos. 6,992,135 and 6,677,401, the entire disclosures of which are hereby incorporated herein by reference.

Specific non-limiting examples of suitable acid copolymers and/or reaction mixtures and/or partial ingredients of reactions mixtures are set forth in TABLES 1, 3, 5, 7 and accompanying related properties tables of parent U.S. patent application Ser. No. 15/235,510, filed Aug. 12, 2016, which is a divisional of U.S. patent application Ser. No. 14/490,976, filed Sep. 19, 2014, now U.S. Pat. No. 9,415,273, each which is hereby incorporated by reference herein in its entirety.

In another embodiment of the present invention, the acid copolymers may be blended with non-acid polymers. For example, an E/X copolymer may be blended with an E/Y copolymer. In this aspect, the E/X copolymer, where E is ethylene and X is a α,β-ethylenically unsaturated carboxylic acid, is blended with the E/Y copolymer, where E is ethylene and Y is a softening comonomer, such as alkyl acrylate and methacrylate, where the alkyl groups have from 1 to 8 carbon atoms. Any of the α,β-ethylenically unsaturated carboxylic acids discussed above with regard to the E/X/Y copolymers are suitable for producing the blends.

The acid copolymers may also be blended with other non-acid polymers including elastomeric polymers. For example, an E/X copolymer may be blended with an E/R copolymer. In this aspect, the E/X copolymer, where E is ethylene and X is a α,β-ethylenically unsaturated carboxylic acid, is blended with the E/R copolymer, where E is ethylene and R is a monomer that when polymerized with ethylene creates an elastomeric polymer. Any of the α,β-ethylenically unsaturated carboxylic acids discussed above with regard to the E/X/Y copolymers are suitable for producing the blends.

Suitable non-acid polymers include, but are not limited to, ethylene-alkyl acrylate polymers, particularly polyethylene-butyl acrylate, polyethylene-methyl acrylate, and polyethylene-ethyl acrylate; metallocene-catalyzed polymers; ethylene-butyl acrylate-carbon monoxide polymers and ethylene-vinyl acetate-carbon monoxide polymers; polyethylene-vinyl acetates; ethylene-alkyl acrylate polymers containing a cure site monomer; ethylene-propylene rubbers and ethylene-propylene-diene monomer rubbers; olefinic ethylene elastomers, particularly ethylene-octene polymers, ethylene-butene polymers, ethylene-propylene polymers, and ethylene-hexene polymers; styrenic block copolymers; polyester elastomers; polyamide elastomers; polyolefin rubbers, particularly polybutadiene, polyisoprene, and styrene-butadiene rubber; and thermoplastic polyurethanes. In a preferred embodiment, the non-acid polymers include polyolefins, polyamides, polyesters, polyethers, polyurethanes, metallocene-catalyzed polymers, single-site catalyst polymerized polymers, ethylene propylene rubber, ethylene propylene diene rubber, styrenic block copolymer rubbers, and alkyl acrylate rubbers.

Additional suitable non-acid polymers are disclosed, for example, in paragraph [0054] of parent U.S. patent application Ser. No. 15/235,510, filed Aug. 12, 2016, which is a divisional of U.S. patent application Ser. No. 14/490,976, filed Sep. 19, 2014, now U.S. Pat. No. 9,415,273, each which is hereby incorporated by reference herein in its entirety. In one embodiment, the non-acid polymers may be present in the reaction mixture in an amount of about 5 weight percent to about 80 weight percent, or about 10 weight percent to about 40 weight percent, or about 15 weight percent to about 25 weight percent.

The reaction mixture may optionally contain one or more melt flow modifiers. The amount of melt flow modifier in the composition is readily determined such that the melt flow index of the composition is at least 0.1 g/10 min, or from 0.5 g/10 min to 10.0 g/10 min, or from 1.0 g/10 min to 6.0 g/10 min, as measured using ASTM D-1238, condition E, at 190° C., using a 2160 gram weight.

Suitable melt flow modifiers include, but are not limited to, the high molecular weight organic acids and salts thereof disclosed above, polyamides, polyesters, polyacrylates, polyurethanes, polyethers, polyureas, polyhydric alcohols, and combinations thereof. Also suitable are the non-fatty acid melt flow modifiers.

The reaction mixture, or color-stable composition as a whole, may also optionally include additives, fillers, and combinations thereof. In one embodiment, the additives and/or fillers may be present in an amount of from 0 weight percent to about 50 weight percent, based on the total weight of the composition. In another embodiment, the additives and/or fillers may be present in an amount of from about 5 weight percent to about 30 weight percent, based on the total weight of the composition. In still another embodiment, the additives and/or fillers may be present in an amount of from about 10 weight percent to about 20 weight percent, based on the total weight of the composition.

A wide variety of fillers are available, and some of these fillers may be used to adjust the specific gravity of the composition as needed. In particular, fillers such as particulates, fibers, or flakes are suitable. Other examples of fillers include aluminum oxide, zinc oxide, tin oxide, barium sulfate, zinc sulfate, calcium oxide, calcium carbonate, zinc carbonate, barium carbonate, tungsten, tungsten carbide, and lead silicate fillers. Also, silica, fumed silica, and precipitated silica, such as those sold under the tradename, HISIL™ from PPG Industries, carbon black, carbon fibers, and nanoscale materials such as nanotubes, nanoflakes, nanofillers, and nanoclays may be used. Other additives and fillers include, but are not limited to, chemical blowing and foaming agents, optical brighteners, coloring agents, fluorescent agents, whitening agents, UV absorbers, light stabilizers, defoaming agents, processing aids, antioxidants, stabilizers, softening agents, fragrance components, plasticizers, impact modifiers, titanium dioxide, acid copolymer wax, surfactants, rubber regrind (recycled core material), clay, mica, talc, glass flakes, milled glass, and mixtures thereof. Suitable additives are more fully described in, for example, Rajagopalan et al., U.S. Patent Application Publication No. 2003/0225197, the entire disclosure of which is hereby incorporated herein by reference. In a particular embodiment, the total amount of additive(s) and filler(s) present in the final color-stable polymer composition is 15 wt. % or less, or 12 wt. % or less, or 10 wt. % or less, or 9 wt. % or less, or 6 wt. % or less, or 5 wt. % or less, or 4 wt. % or less, or 3 wt. % or less, based on the total weight of the color-stable polymer composition.

In turn, the core may be a conventional rubber-containing inner core, wherein the base rubber may be selected from polybutadiene rubber, polyisoprene rubber, natural rubber, ethylene-propylene rubber, ethylene-propylene diene rubber, styrene-butadiene rubber, and combinations of two or more thereof. A preferred base rubber is polybutadiene. Another preferred base rubber is polybutadiene optionally mixed with one or more elastomers selected from polyisoprene rubber, natural rubber, ethylene propylene rubber, ethylene propylene diene rubber, styrene-butadiene rubber, polystyrene elastomers, polyethylene elastomers, polyurethane elastomers, polyurea elastomers, metallocene-catalyzed elastomers, and plastomers.

Suitable curing processes include, for example, peroxide curing, sulfur curing, radiation, and combinations thereof. In one embodiment, the base rubber is peroxide cured. Organic peroxides suitable as free-radical initiators include, for example, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. Peroxide free-radical initiators are generally present in the rubber compositions in an amount within the range of 0.05 to 15 parts, or 0.1 to 10 parts, or 0.25 to 6 parts by weight per 100 parts of the base rubber. Cross-linking agents are used to cross-link at least a portion of the polymer chains in the composition. Suitable cross-linking agents include, for example, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. Particularly suitable metal salts include, for example, one or more metal salts of acrylates, diacrylates, methacrylates, and dimethacrylates, wherein the metal is selected from magnesium, calcium, zinc, aluminum, lithium, and nickel. In a particular embodiment, the cross-linking agent is selected from zinc salts of acrylates, diacrylates, methacrylates, and dimethacrylates. When the cross-linking agent is zinc diacrylate and/or zinc dimethacrylate, the agent typically is included in the rubber composition in an amount within the range of 1 to 60 parts, or 5 to 50 parts, or 10 to 40 parts, by weight per 100 parts of the base rubber.

In a preferred embodiment, the cross-linking agent used in the rubber composition of the core and epoxy composition of the intermediate layer and/or cover layer is zinc diacrylate ("ZDA"). Adding the ZDA curing agent to the rubber composition makes the core harder and improves the resiliency/CoR of the ball. Adding the same ZDA curing agent epoxy composition makes the intermediate and cover layers harder and more rigid. As a result, the overall durability, toughness, and impact strength of the ball is improved.

Sulfur and sulfur-based curing agents with optional accelerators may be used in combination with or in replacement of the peroxide initiators to cross-link the base rubber. High energy radiation sources capable of generating free-radicals may also be used to cross-link the base rubber. Suitable examples of such radiation sources include, for example, electron beams, ultra-violet radiation, gamma radiation, X-ray radiation, infrared radiation, heat, and combinations thereof.

The rubber compositions may also contain "soft and fast" agents such as a halogenated organosulfur, organic disulfide, or inorganic disulfide compound. Particularly suitable halogenated organosulfur compounds include, but are not limited to, halogenated thiophenols. Preferred organic sulfur compounds include, but not limited to, pentachlorothiophenol ("PCTP") and a salt of PCTP. A preferred salt of PCTP is ZnPCTP. A suitable PCTP is sold by the Struktol Company (Stow, Ohio) under the tradename, A 95. ZnPCTP is commercially available from eChinaChem Inc. (San Francisco, Calif.). These compounds also may function as cis-to-trans catalysts to convert some cis-1,4 bonds in the polybutadiene to trans-1,4 bonds. Peroxide free-radical initiators are generally present in the rubber compositions in an amount within the range of 0.05 to 10 parts, or 0.1 to 5 parts. Antioxidants also may be added to the rubber compositions to prevent the breakdown of the elastomers. Other ingredients such as accelerators (for example, tetra methylthiurams), processing aids, processing oils, dyes and pigments, wetting agents, surfactants, plasticizers, as well as other additives known in the art may be added to the composition. Generally, the fillers and other additives are present in the rubber composition in an amount within the range of 1 to 70 parts by weight per 100 parts of the base rubber. The core may be formed by mixing and forming the rubber composition using conventional techniques. Of course, embodiments are also envisioned wherein outer layers comprise such rubber-based compositions.

And while the at least one layer of Experimental golf ball Ex. 1 of TABLE I is an ionomeric cover layer formed about a polybutadiene single core, embodiments are also envisioned wherein the at least one layer itself and/or other golf ball layers are formed from golf ball materials other than ionomers such as those set forth below. In this regard, it is envisioned that the following conventional compositions as known in the art may be incorporated in a golf ball of the invention either in connection with the layer comprising the color concentrate composition or in other layers of a golf ball of the invention in order to target and achieve particular desired golf ball characteristics:

(1) Polyurethanes, such as those prepared from polyols and diisocyanates or polyisocyanates and/or their prepolymers, and those disclosed in U.S. Pat. Nos. 5,334,673 and 6,506,851;

(2) Polyureas, such as those disclosed in U.S. Pat. Nos. 5,484,870 and 6,835,794; and (3) Polyurethane/urea hybrids, blends or copolymers comprising urethane and urea segments such as those disclosed in U.S. Pat. No. 8,506,424.

Suitable polyurethane compositions comprise a reaction product of at least one polyisocyanate and at least one curing agent. The curing agent can include, for example, one or more polyols. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. Suitable polyurethanes are described in U.S. Pat. No. 7,331,878, which is incorporated herein in its entirety by reference.

In general, polyurea compositions contain urea linkages formed by reacting an isocyanate group (—N═C═O) with an amine group (NH or $NH_2$). The chain length of the polyurea prepolymer is extended by reacting the prepolymer with an amine curing agent. The resulting polyurea has elastomeric properties, because of its "hard" and "soft" segments, which are covalently bonded together. The soft, amorphous, low-melting point segments, which are formed from the polyamines, are relatively flexible and mobile, while the hard, high-melting point segments, which are formed from the isocyanate and chain extenders, are relatively stiff and immobile. The phase separation of the hard and soft segments provides the polyurea with its elastomeric resiliency. The polyurea composition contains urea linkages having the following general structure:

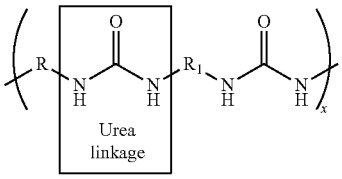

where x is the chain length, i.e., about 1 or greater, and R and $R_1$ are straight chain or branched hydrocarbon chains having about 1 to about 20 carbon atoms.

A polyurea/polyurethane hybrid composition is produced when the polyurea prepolymer (as described above) is chain-extended using a hydroxyl-terminated curing agent. Any excess isocyanate groups in the prepolymer will react with the hydroxyl groups in the curing agent and create urethane linkages. That is, a polyurea/polyurethane hybrid composition is produced.

In a preferred embodiment, a pure polyurea composition, as described above, is prepared. That is, the composition contains only urea linkages. An amine-terminated curing agent is used in the reaction to produce the pure polyurea composition. However, it should be understood that a polyurea/polyurethane hybrid composition also may be prepared in accordance with this invention as discussed above. Such a hybrid composition can be formed if the polyurea prepolymer is cured with a hydroxyl-terminated curing agent. Any excess isocyanate in the polyurea prepolymer reacts with the hydroxyl groups in the curing agent and forms urethane linkages. The resulting polyurea/polyurethane hybrid composition contains both urea and urethane linkages. The general structure of a urethane linkage is shown below:

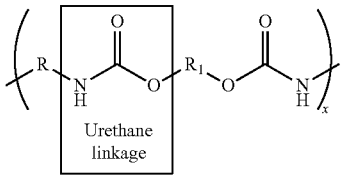

where x is the chain length, i.e., about 1 or greater, and R and $R_1$ are straight chain or branched hydrocarbon chains having about 1 to about 20 carbon atoms.

There are two basic techniques that can be used to make the polyurea and polyurea/urethane compositions of this invention: a) one-shot technique, and b) prepolymer technique. In the one-shot technique, the isocyanate blend, polyamine, and hydroxyl and/or amine-terminated curing agent are reacted in one step. On the other hand, the prepolymer technique involves a first reaction between the isocyanate blend and polyamine to produce a polyurea prepolymer, and a subsequent reaction between the prepolymer and hydroxyl and/or amine-terminated curing agent. As a result of the reaction between the isocyanate and polyamine compounds, there will be some unreacted NCO groups in the polyurea prepolymer. The prepolymer should have less than 14% unreacted NCO groups. Alternatively, the prepolymer can have no greater than 8.5% unreacted NCO groups, or from 2.5% to 8%, or from 5.0% to 8.0% unreacted NCO groups. As the weight percent of unreacted isocyanate groups increases, the hardness of the composition also generally increases.

Either the one-shot or prepolymer method may be employed to produce the polyurea and polyurea/urethane compositions of the invention; however, the prepolymer technique is preferred because it provides better control of the chemical reaction. The prepolymer method provides a more homogeneous mixture resulting in a more consistent polymer composition. The one-shot method results in a mixture that is inhomogeneous (more random) and affords the manufacturer less control over the molecular structure of the resultant composition.

In the casting process, the polyurea and polyurea/urethane compositions can be formed by chain-extending the polyurea prepolymer with a single curing agent or blend of curing agents as described further below. The compositions of the present invention may be selected from among both castable thermoplastic and thermoset materials. Thermoplastic polyurea compositions are typically formed by reacting the isocyanate blend and polyamines at a 1:1 stoichiometric ratio. Thermoset compositions, on the other hand, are cross-linked polymers and are typically produced from the reaction of the isocyanate blend and polyamines at normally a 1.05:1 stoichiometric ratio. In general, thermoset polyurea compositions are easier to prepare than thermoplastic polyureas.

The polyurea prepolymer can be chain-extended by reacting it with a single curing agent or blend of curing agents (chain-extenders). In general, the prepolymer can be reacted with hydroxyl-terminated curing agents, amine-terminated curing agents, or mixtures thereof. The curing agents extend the chain length of the prepolymer and build-up its molecular weight. Normally, the prepolymer and curing agent are mixed so the isocyanate groups and hydroxyl or amine groups are mixed at a 1.05:1.00 stoichiometric ratio.

A catalyst may be employed to promote the reaction between the isocyanate and polyamine compounds for producing the prepolymer or between prepolymer and curing agent during the chain-extending step. The catalyst can be added to the reactants before producing the prepolymer. Suitable catalysts include, but are not limited to, bismuth catalyst; zinc octoate; stannous octoate; tin catalysts such as bis-butyltin dilaurate, bis-butyltin diacetate, stannous octoate; tin (II) chloride, tin (IV) chloride, bis-butyltin dimethoxide, dimethyl-bis[1-oxonedecyl)oxy]stannane, di-n-octyltin bis-isooctyl mercaptoacetate; amine catalysts such as triethylenediamine, triethylamine, and tributylamine; organic acids such as oleic acid and acetic acid; delayed catalysts; and mixtures thereof. The catalyst is preferably added in an amount sufficient to catalyze the reaction of the components in the reactive mixture. In one embodiment, the catalyst is present in an amount from about 0.001 percent to about 1 percent, or 0.1 to 0.5 percent, by weight of the composition.

The hydroxyl chain-extending (curing) agents are preferably selected from the group consisting of ethylene glycol; diethylene glycol; polyethylene glycol; propylene glycol; 2-methyl-1,3-propanediol; 2-methyl-1,4-butanediol; monoethanolamine; diethanolamine; triethanolamine; monoisopropanolamine; diisopropanolamine; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; N,N,N',N'-tetra-(2-hydroxypropyl)-ethylene diamine; diethylene glycol bis-(aminopropyl) ether; 1,5-pentanediol; 1,6-hexanediol; 1,3-bis-(2-hydroxyethoxy) cyclohexane; 1,4-cyclohexyldimethylol; 1,3-bis-[2-(2-hydroxyethoxy) ethoxy]cyclohexane; 1,3-bis-{2-[2-(2-hydroxyethoxy) ethoxy]ethoxy}cyclohexane; trimethylolpropane; polytetramethylene ether glycol (PTMEG), having a molecular weight, for example, of from about 250 to about 3900; and mixtures thereof.

Suitable amine chain-extending (curing) agents that can be used in chain-extending the polyurea prepolymer of this invention include, but are not limited to, unsaturated diamines such as 4,4'-diamino-diphenylmethane (i.e., 4,4'-methylene-dianiline or "MDA"), m-phenylenediamine, p-phenylenediamine, 1,2- or 1,4-bis(sec-butylamino)benzene, 3,5-diethyl-(2,4- or 2,6-) toluenediamine or "DETDA", 3,5-dimethylthio-(2,4- or 2,6-)toluenediamine, 3,5-diethylthio-(2,4- or 2,6-)toluenediamine, 3,3'-dimethyl-4,4'-diamino-diphenylmethane, 3,3'-diethyl-5,5'-dimethyl4,4'-diamino-diphenylmethane (i.e., 4,4'-methylene-bis(2-ethyl-6-methyl-benezeneamine)), 3,3'-dichloro-4,4'-diamino-diphenylmethane (i.e., 4,4'-methylene-bis(2-chloroaniline) or "MOCA"), 3,3',5,5'-tetraethyl-4,4'-diamino-diphenylmethane (i.e., 4,4'-methylene-bis(2,6-diethylaniline), 2,2'-dichloro-3,3',5,5'-tetraethyl-4,4'-diamino-diphenylmethane (i.e., 4,4'-methylene-bis(3-chloro-2,6-diethyleneaniline) or "MCDEA"), 3,3'-diethyl-5,5'-dichloro-4,4'-diamino-diphenylmethane, or "MDEA"), 3,3'-dichloro-2,2',6,6'-tetraethyl-4,4'-diamino-diphenylmethane, 3,3'-dichloro-4,4'-diamino-diphenylmethane, 4,4'-methylene-bis(2,3-dichloroaniline) (i.e., 2,2',3,3'-tetrachloro-4,4'-diamino-diphenylmethane or "MDCA"), 4,4'-bis(sec-butylamino)-diphenylmethane, N,N'-dialkylamino-diphenylmethane, trimethyleneglycol-di(p-aminobenzoate), polyethyleneglycol-di(p-aminobenzoate), polytetramethyleneglycol-di(p-aminobenzoate); saturated diamines such as ethylene diamine, 1,3-propylene diamine, 2-methyl-pentamethylene diamine, hexamethylene diamine, 2,2,4- and 2,4,4-trimethyl-1,6-hexane diamine, imino-bis(propylamine), imido-bis(propylamine), methylimino-bis(propylamine) (i.e., N-(3-aminopropyl)-N-methyl-1,3-propanediamine), 1,4-bis(3-aminopropoxy)butane (i.e., 3,3'-[1,4-butanediyl-bis-(oxy)bis]-1-propanamine), diethyleneglycol-bis(propylamine) (i.e., diethyleneglycol-di(aminopropyl)ether), 4,7,10-trioxatridecane-1,13-diamine, 1-methyl-2,6-diamino-cyclohexane, 1,4-diamino-cyclohexane, poly(oxyethylene-oxypropylene) diamines, 1,3- or 1,4-bis(methylamino)-cyclohexane, isophorone diamine, 1,2- or 1,4-bis(sec-butylamino)-cyclohexane, N,N'-diisopropyl-isophorone diamine, 4,4'-diamino-dicyclohexylmethane, 3,3'-dimethyl-4,4'-diamino-dicyclohexylmethane, 3,3'-dichloro-4,4'-diamino-dicyclohexylmethane, N,N'-dialkylamino-dicyclohexylmethane, polyoxyethylene diamines, 3,3'-diethyl-5,5'-dimethyl-4,4'-diamino-dicyclohexylmethane, polyoxypropylene diamines, 3,3'-diethyl-5,5'-dichloro-4,4'-diamino-dicyclohexylmethane, polytetramethylene ether diamines, 3,3',5,5 '-tetraethyl-4,4'-diamino-dicyclohexylmethane (i.e., 4,4'-methylene-bis(2,6-diethylaminocyclohexane)), 3,3'-dichloro-4,4'-diamino-dicyclohexylmethane, 2,2'-dichloro-3,3',5,5'-tetraethyl-4,4'-diamino-dicyclohexylmethane, (ethylene oxide)-capped polyoxypropylene ether diamines, 2,2',3,3'-tetrachloro-4,4'-diamino-dicyclohexylmethane, 4,4'-bis(sec-butylamino)-dicyclohexylmethane; triamines such as diethylene triamine, dipropylene triamine, (propylene oxide)-based triamines (i.e., polyoxypropylene triamines), N-(2-aminoethyl)-1,3-propylenediamine (i.e., $N_3$-amine), glycerin-based triamines, (all saturated); tetramines such as N,N'-bis(3-aminopropyl)ethylene diamine (i.e., $N_4$-amine) (both saturated), triethylene tetramine; and other polyamines such as tetraethylene pentamine (also saturated). One suitable amine-terminated chain-extending agent is Ethacure 300™ (dimethylthiotoluenediamine or a mixture of 2,6-diamino-3,5-dimethylthiotoluene and 2,4-diamino-3,5-dimethylthiotoluene.) The amine curing agents used as chain extenders normally have a cyclic structure and a low molecular weight (250 or less).

When the polyurea prepolymer is reacted with amine-terminated curing agents during the chain-extending step, as described above, the resulting composition is essentially a pure polyurea composition. On the other hand, when the polyurea prepolymer is reacted with a hydroxyl-terminated curing agent during the chain-extending step, any excess isocyanate groups in the prepolymer will react with the hydroxyl groups in the curing agent and create urethane linkages to form a polyurea/urethane hybrid.

This chain-extending step, which occurs when the polyurea prepolymer is reacted with hydroxyl curing agents, amine curing agents, or mixtures thereof, builds-up the molecular weight and extends the chain length of the prepolymer. When the polyurea prepolymer is reacted with amine curing agents, a polyurea composition having urea linkages is produced. When the polyurea prepolymer is reacted with hydroxyl curing agents, a polyurea/urethane hybrid composition containing both urea and urethane linkages is produced. The polyurea/urethane hybrid composition is distinct from the pure polyurea composition. The concentration of urea and urethane linkages in the hybrid composition may vary. In general, the hybrid composition may contain a mixture of about 10 to 90% urea and about 90 to 10% urethane linkages. The resulting polyurea or polyurea/urethane hybrid composition has elastomeric properties based on phase separation of the soft and hard segments. The soft segments, which are formed from the polyamine reactants, are generally flexible and mobile, while the hard segments, which are formed from the isocyanates and chain extenders, are generally stiff and immobile.

In an alternative embodiment, the cover layer may comprise a conventional polyurethane or polyurethane/urea hybrid composition. In general, polyurethane compositions contain urethane linkages formed by reacting an isocyanate group (—N═C═O) with a hydroxyl group (OH). The polyurethanes are produced by the reaction of a multifunctional isocyanate (NCO—R—NCO) with a long-chain polyol having terminal hydroxyl groups (OH—OH) in the presence of a catalyst and other additives. The chain length of the polyurethane prepolymer is extended by reacting it with short-chain diols (OH—R'—OH). The resulting polyurethane has elastomeric properties because of its "hard" and "soft" segments, which are covalently bonded together. This phase separation occurs because the mainly non-polar, low melting soft segments are incompatible with the polar, high melting hard segments. The hard segments, which are formed by the reaction of the diisocyanate and low molecular weight chain-extending diol, are relatively stiff and immobile. The soft segments, which are formed by the reaction of the diisocyanate and long chain diol, are relatively flexible and mobile. Because the hard segments are covalently coupled to the soft segments, they inhibit plastic flow of the polymer chains, thus creating elastomeric resiliency.

Suitable isocyanate compounds that can be used to prepare the polyurethane or polyurethane/urea hybrid material are described above. These isocyanate compounds are able to react with the hydroxyl or amine compounds and form a durable and tough polymer having a high melting point. The resulting polyurethane generally has good mechanical strength and cut/shear-resistance. In addition, the polyurethane composition has good light and thermal-stability.

When forming a polyurethane prepolymer, any suitable polyol may be reacted with the above-described isocyanate blends in accordance with this invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. The polyol may include PTMEG.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups. In still another embodiment, polycaprolactone polyols are included in the materials of the invention. Suitable polycaprolactone polyols include, but are not limited to: 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups. In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

In a manner similar to making the above-described polyurea compositions, there are two basic techniques that can be used to make the polyurethane compositions of this invention: a) one-shot technique, and b) prepolymer technique. In the one-shot technique, the isocyanate blend, polyol, and hydroxyl-terminated and/or amine-terminated chain-extender (curing agent) are reacted in one step. On the other hand, the prepolymer technique involves a first reaction between the isocyanate blend and polyol compounds to produce a polyurethane prepolymer, and a subsequent reaction between the prepolymer and hydroxyl-terminated and/or amine-terminated chain-extender. As a result of the reaction between the isocyanate and polyol compounds, there will be some unreacted NCO groups in the polyurethane prepolymer. The prepolymer may have less than 14% unreacted NCO groups, or no greater than 8.5% unreacted NCO groups, or from 2.5% to 8%, or from 5.0% to 8.0% unreacted NCO groups. As the weight percent of unreacted isocyanate groups increases, the hardness of the composition also generally increases.

Either the one-shot or prepolymer method may be employed to produce the polyurethane compositions of the invention. In one embodiment, the one-shot method is used, wherein the isocyanate compound is added to a reaction vessel and then a curative mixture comprising the polyol and curing agent is added to the reaction vessel. The components are mixed together so that the molar ratio of isocyanate groups to hydroxyl groups is in the range of about 1.01:1.00 to about 1.10:1.00. The molar ratio can be greater than or equal to 1.05:1.00. For example, the molar ratio can be in the range of 1.05:1.00 to 1.10:1.00. In a second embodiment, the prepolymer method is used. In general, the prepolymer technique is preferred because it provides better control of the chemical reaction. The prepolymer method provides a more homogeneous mixture resulting in a more consistent polymer composition. The one-shot method results in a mixture that is inhomogeneous (more random) and affords the manufacturer less control over the molecular structure of the resultant composition.

The polyurethane compositions can be formed by chain-extending the polyurethane prepolymer with a single curing agent (chain-extender) or blend of curing agents (chain-extenders) as described further below. The compositions of the present invention may be selected from among both castable thermoplastic and thermoset polyurethanes. Thermoplastic polyurethane compositions are typically formed by reacting the isocyanate blend and polyols at a 1:1 stoichiometric ratio. Thermoset compositions, on the other hand, are cross-linked polymers and are typically produced from the reaction of the isocyanate blend and polyols at normally a 1.05:1 stoichiometric ratio. In general, thermoset polyurethane compositions are easier to prepare than thermoplastic polyurethanes.

As discussed above, the polyurethane prepolymer can be chain-extended by reacting it with a single chain-extender or blend of chain-extenders. In general, the prepolymer can be reacted with hydroxyl-terminated curing agents, amine-terminated curing agents, and mixtures thereof. The curing agents extend the chain length of the prepolymer and build-up its molecular weight. Normally, the prepolymer and curing agent are mixed so the isocyanate groups and hydroxyl or amine groups are mixed at a 1.05:1.00 stoichiometric ratio.

A catalyst may be employed to promote the reaction between the isocyanate and polyol compounds for producing the polyurethane prepolymer or between the polyurethane prepolymer and chain-extender during the chain-extending step. The catalyst can be added to the reactants before producing the polyurethane prepolymer. Suitable catalysts include, but are not limited to, the catalysts described above for making the polyurea prepolymer. The catalyst may be added in an amount sufficient to catalyze the reaction of the components in the reactive mixture. In one embodiment, the catalyst is present in an amount from about 0.001 percent to about 1 percent, or 0.1 to 0.5 percent, by weight of the composition.

Suitable hydroxyl chain-extending (curing) agents and amine chain-extending (curing) agents include, but are not limited to, the curing agents described above for making the polyurea and polyurea/urethane hybrid compositions. When the polyurethane prepolymer is reacted with hydroxyl-terminated curing agents during the chain-extending step, as described above, the resulting polyurethane composition contains urethane linkages. On the other hand, when the polyurethane prepolymer is reacted with amine-terminated curing agents during the chain-extending step, any excess isocyanate groups in the prepolymer will react with the amine groups in the curing agent. The resulting polyurethane composition contains urethane and urea linkages and may be referred to as a polyurethane/urea hybrid. The concentration of urethane and urea linkages in the hybrid composition may vary. In general, the hybrid composition may contain a mixture of about 10 to 90% urethane and about 90 to 10% urea linkages.

Those layers of golf balls of the invention comprising conventional thermoplastic or thermoset materials may be formed using a variety of conventional application techniques such as compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials. These and other manufacture methods are disclosed in U.S. Pat. Nos. 6,207,784 and 5,484,870, the disclosures of which are incorporated herein by reference in their entireties.

A method of injection molding using a split vent pin can be found in co-pending U.S. Pat. No. 6,877,974, filed Dec. 22, 2000, entitled "Split Vent Pin for Injection Molding." Examples of retractable pin injection molding may be found in U.S. Pat. Nos. 6,129,881; 6,235,230; and 6,379,138. These molding references are incorporated in their entirety by reference herein. In addition, a chilled chamber, i.e., a cooling jacket, such as the one disclosed in U.S. Pat. No. 6,936,205, filed Nov. 22, 2000, entitled "Method of Making Golf Balls" may be used to cool the compositions of the invention when casting, which also allows for a higher loading of catalyst into the system.

Conventionally, compression molding and injection molding are applied to thermoplastic materials, whereas RIM, liquid injection molding, and casting are employed on thermoset materials. These and other manufacture methods are disclosed in U.S. Pat. Nos. 6,207,784 and 5,484,870, the disclosures of which are incorporated herein by reference in their entirety.

Castable reactive liquid polyurethanes and polyurea materials may be applied over the inner ball using a variety of application techniques such as casting, injection molding spraying, compression molding, dipping, spin coating, or flow coating methods that are well known in the art. In one embodiment, the castable reactive polyurethanes and polyurea material is formed over the core using a combination of casting and compression molding. Conventionally, compression molding and injection molding are applied to thermoplastic cover materials, whereas RIM, liquid injection molding, and casting are employed on thermoset cover materials.

U.S. Pat. No. 5,733,428, the entire disclosure of which is hereby incorporated by reference, discloses a method for forming a polyurethane cover on a golf ball core. Because this method relates to the use of both casting thermosetting and thermoplastic material as the golf ball cover, wherein the cover is formed around the core by mixing and introducing the material in mold halves, the polyurea compositions may also be used employing the same casting process.

For example, once a polyurea composition is mixed, an exothermic reaction commences and continues until the material is solidified around the core. It is important that the viscosity be measured over time, so that the subsequent steps of filling each mold half, introducing the core into one half and closing the mold can be properly timed for accomplishing centering of the core cover halves fusion and achieving overall uniformity. A suitable viscosity range of the curing urea mix for introducing cores into the mold halves is determined to be approximately between about 2,000 cP and about 30,000 cP, or within a range of about 8,000 cP to about 15,000 cP.

To start the cover formation, mixing of the prepolymer and curative is accomplished in a motorized mixer inside a mixing head by feeding through lines metered amounts of curative and prepolymer. Top preheated mold halves are filled and placed in fixture units using centering pins moving into apertures in each mold. At a later time, the cavity of a bottom mold half, or the cavities of a series of bottom mold halves, is filled with similar mixture amounts as used for the top mold halves. After the reacting materials have resided in top mold halves for about 40 to about 100 seconds, or about 70 to about 80 seconds, a core is lowered at a controlled speed into the gelling reacting mixture.

A ball cup holds the shell through reduced pressure (or partial vacuum). Upon location of the core in the halves of the mold after gelling for about 4 to about 12 seconds, the vacuum is released allowing the core to be released. In one embodiment, the vacuum is released allowing the core to be released after about 5 seconds to 10 seconds. The mold halves, with core and solidified cover half thereon, are removed from the centering fixture unit, inverted and mated with second mold halves which, at an appropriate time earlier, have had a selected quantity of reacting polyurea prepolymer and curing agent introduced therein to commence gelling.

Similarly, U.S. Pat. No. 5,006,297 and U.S. Pat. No. 5,334,673 both also disclose suitable molding techniques that may be utilized to apply the castable reactive liquids employed in the present invention.

However, golf balls of the invention may be made by any known technique to those skilled in the art.

Examples of yet other materials which may be suitable for incorporating and coordinating in order to target and achieve desired playing characteristics or feel include plasticized thermoplastics, polyalkenamer compositions, polyester-based thermoplastic elastomers containing plasticizers, transparent or plasticized polyamides, thiolene compositions, poly-amide and anhydride-modified polyolefins, organic acid-modified polymers, and the like.

Advantageously, a golf ball of the invention incorporating at least one layer comprising/consisting of a color-stable polymer composition is not limited to a particular golf ball construction, and a layer of a color-stable polymer composition can be disposed in connection with a variety of other layers in golf ball constructions targeting particular golf ball characteristics or properties. In this regard, dimensions of golf ball components, i.e., thickness and diameter, may vary depending on the desired properties. Meanwhile, the materials of each layer, including the layer of color-stable composition, can be modified and coordinated in order to target golf ball properties such as hardness, modulus, compression, CoR, spin and initial velocity.

In one non-limiting example, a golf ball of the invention may comprise a single core having a diameter of from about 1.20 in. to about 1.65 in. Alternatively, the core may have a dual core arrangement having a total diameter of from about 1.40 in. to about 1.65 in, for example, wherein the inner core may has a diameter of from about 0.75 inches to about 1.30 in. and the outer core has a thickness of from about 0.05 in. to about 0.45 in. Cover thicknesses generally range from about 0.015 in. to about 0.090 inches, although a golf ball of the invention may comprise any known thickness. Meanwhile, casing layers and inner cover layers each typically have thicknesses ranging from about 0.01 in. to about 0.06 in. A golf ball of the invention may also have one or more film layers, paint layers or coating layers having a combined thickness of from about 0.1 μm to about 100 μm, or from about 2 μm to about 50 μm, or from about 2 μm to about 30 μm. Meanwhile, each coating layer may have a thickness of from about 0.1 μm to about 50 μm, or from about 0.1 μm to about 25 μm, or from about 0.1 μm to about 14 μm, or from about 2 μm to about 9 μm, for example.

In a particular embodiment, the golf ball has one or more of the following properties:

(a) a center having a diameter within a range having a lower limit of 0.250 or 0.500 or 0.600 or 0.750 or 0.800 or 1.000 or 1.100 or 1.200 inches and an upper limit of 1.300 or 1.350 or 1.400 or 1.500 or 1.510 or 1.530 or 1.550 or 1.570 or 1.580 or 1.600 inches;

(b) an intermediate core layer having a thickness within a range having a lower limit of 0.020 or 0.025 or 0.032 or 0.050 or 0.075 or 0.100 or 0.125 inches and an upper limit of 0.150 or 0.175 or 0.200 or 0.220 or 0.250 or 0.280 or 0.300 inches;

(c) an outer core layer having a thickness within a range having a lower limit of 0.010 or 0.020 or 0.025 or 0.030 or 0.032 inches and an upper limit of 0.070 or 0.080 or 0.100 or 0.150 or 0.310 or 0.440 or 0.560 inches;

(d) an intermediate core layer and an outer core layer having a combined thickness within a range having a lower limit of 0.040 inches and an upper limit of 0.560 or 0.800 inches;

(e) an outer core layer having a thickness such that a golf ball subassembly including the center, intermediate core layer, and core layer has an outer diameter within a range having a lower limit of 1.000 or 1.300 or 1.400 or 1.450 or 1.500 or 1.510 or 1.530 or 1.550 inches and an upper limit of 1.560 or 1.570 or 1.580 or 1.590 or 1.600 or 1.620 or 1.640 inches;

(f) a center having a surface hardness of 65 Shore C or greater, or 70 Shore C or greater, or a surface hardness within a range having a lower limit of 55 or 60 or 65 or 70 or 75 Shore C and an upper limit of 80 or 85 Shore C;

(g) a center having a center hardness (H) within a range having a lower limit of 20 or 25 or 30 or 35 or 45 or 50 or 55 Shore C and an upper limit of 60 or 65 or 70 or 75 or 90 Shore C; an outer core layer having a surface hardness (S) within a range having a lower limit of 20 or 25 or 30 or 35 or 45 or 55 Shore C and an upper limit of 60 or 70 or 75 or 90 Shore C; and (i) H=S;

(ii) H<S, and the difference between H and S is from −15 to 40, preferably from −15 to 22, more preferably from −10 to 15, and even more preferably from −5 to 10; or (iii) S<H, and the difference between H and S is from −15 to 40, preferably from −15 to 22, more preferably from −10 to 15, and even more preferably from −5 to 10;

(h) an intermediate layer having a surface hardness (I) that is greater than both the center hardness of the center (H) and the surface hardness of the outer core layer (S); I is preferably 40 Shore C or greater or within a range having an lower limit of 40 or 45 or 50 or 85 Shore C and an upper limit of 90 or 93 or 95 Shore C; the Shore D range for I is preferably from 40 to 80, more preferably from 50 to 70;

(i) each core layer having a specific gravity of from 0.50 g/cc to 5.00 g/cc; preferably from 1.05 g/cc to 1.25 g/cc; more preferably from 1.10 g/cc to 1.18 g/cc;

(j) a center having a surface hardness greater than or equal to the center hardness of the center;

(k) a center having a positive hardness gradient wherein the surface hardness of the center is at least 10 Shore C units greater than the center hardness of the center;

(l) an outer core layer having a surface hardness greater than or equal to the surface hardness and center hardness of the center;

(m) a center having a compression of 40 or less;

(n) a center having a compression of from 20 to 40; and (o) a golf ball subassembly including the center and the intermediate core layer has a compression of 30 or greater, or 40 or greater, or 50 or greater, or 60 or greater, or a compression within a range having a lower limit of 30 or 40 or 50 or 60 and an upper limit of 65 or 75 or 85 or 95 or 105.

In another embodiment, the present invention is directed to a golf ball comprising a center, an outer core layer, an intermediate core layer disposed between the center and the outer core layer, and one or more cover layers, wherein the golf ball has one or more of the following properties:

(a) a center having a diameter within a range having a lower limit of 0.100 or 0.125 or 0.250 inches and an upper limit of 0.375 or 0.500 or 0.750 or 1.000 inches;

(b) an intermediate core layer having a thickness within a range having a lower limit of 0.050 or 0.075 or 0.100 or 0.125 or 0.150 or 0.200 inches and an upper limit of 0.300 or 0.350 or 0.400 or 0.500 inches;

(c) an outer core layer having a thickness within a range having a lower limit of 0.010 or 0.020 or 0.025 or 0.030 or 0.032 inches and an upper limit of 0.070 or 0.080 or 0.100 or 0.150 or 0.310 or 0.440 or 0.560 inches;

(d) an outer core layer having a thickness such that a golf ball subassembly including the center, intermediate core layer, and core layer has an outer diameter within a range having a lower limit of 1.000 or 1.300 or 1.400 or 1.450 or 1.500 or 1.510 or 1.530 or 1.550 inches and an upper limit of 1.560 or 1.570 or 1.580 or 1.590 or 1.600 or 1.620 or 1.640 or 1.660 inches;

(e) a center having a surface hardness of 65 Shore C or greater, or 70 Shore C or greater, or greater than 70 Shore C, or 80 Shore C or greater, or a surface hardness within a range having a lower limit of 70 or 75 or 80 Shore C and an upper limit of 90 or 95 Shore C;

(f) an outer core layer having a surface hardness less than or equal to the surface hardness of the center;

(g) an outer core having a surface hardness of 65 Shore C or greater, or 70 Shore C or greater, or greater than 70 Shore C, or 80 Shore C or greater, or 85 Shore C or greater;

(h) an intermediate core layer having a surface hardness that is less than both the surface hardness of the center and the surface hardness of the outer core layer;

(i) an intermediate core layer having a surface hardness of less than 80 Shore C, or less than 70 Shore C, or less than 60 Shore C;

(j) a center specific gravity less than or equal to or substantially the same as (i.e., within 0.1 g/cc) the outer core layer specific gravity;

(j) a center specific gravity within a range having a lower limit of 0.50 or 0.90 or 1.05 or 1.13 g/cc and an upper limit of 1.15 or 1.18 or 1.20 g/cc;

(k) an outer core layer specific gravity of 1.00 g/cc or greater, or 1.05 g/cc or greater, or 1.10 g/cc or greater;

(l) an intermediate core layer specific gravity of 1.00 g/cc or greater, or 1.05 g/cc or greater, or 1.10 g/cc or greater;

(m) an intermediate core layer specific gravity substantially the same as (i.e., within 0.1 g/cc) the outer core layer specific gravity;

(n) a center having a surface hardness greater than or equal to the center hardness of the center;

(o) a center having a positive hardness gradient wherein the surface hardness of the center is at least 10 Shore C units greater than the center hardness of the center;

(p) a center having a compression of 40 or less;

(q) a center having a compression of from 20 to 40; and (r) a golf ball subassembly including the center and the intermediate core layer has a compression of 30 or greater, or 40 or greater, or 50 or greater, or 60 or greater, or a compression within a range having a lower limit of 30 or 40 or 50 or 60 or 65 and an upper limit of 70 or 75 or 85 or 90 or 95 or 105.

In another embodiment, the present invention is directed to a golf ball comprising a center, an outer core layer, and one or more cover layers. In a particular aspect of this embodiment, the golf ball has one or more of the following properties:

(a) a center having a diameter within a range having a lower limit of 0.500 or 0.750 or 1.000 or 1.100 or 1.200 inches and an upper limit of 1.300 or 1.350 or 1.400 or 1.550 or 1.570 or 1.580 inches;

(b) a center having a diameter within a range having a lower limit of 0.750 or 0.850 or 0.875 inches and an upper limit of 1.125 or 1.150 or 1.190 inches;

(c) an outer core layer enclosing the center such that the dual-layer core has an overall diameter within a range having a lower limit of 1.400 or 1.500 or 1.510 or 1.520 or 1.525 inches and an upper limit of 1.540 or 1.550 or 1.555 or 1.560 or 1.590 inches, or an outer core layer having a thickness within a range having a lower limit of 0.020 or 0.025 or 0.032 inches and an upper limit of 0.310 or 0.440 or 0.560 inches;

(d) a center having a center hardness of 50 Shore C or greater, or 55 Shore C or greater, or 60 Shore C or greater, or a center hardness within a range having a lower limit of 50 or 55 or 60 Shore C and an upper limit of 65 or 70 or 80 Shore C;

(e) a center having a surface hardness of 65 Shore C or greater, or 70 Shore C or greater, or a surface hardness within a range having a lower limit of 55 or 60 or 65 or 70 or 75 Shore C and an upper limit of 80 or 85 Shore C;

(f) an outer core layer having a surface hardness of 75 Shore C or greater, or 80 Shore C or greater, or greater than 80 Shore C, or 85 Shore C or greater, or greater than 85 Shore C, or 87 Shore C or greater, or greater than 87 Shore C, or 89 Shore C or greater, or greater than 89 Shore C, or 90 Shore C or greater, or greater than 90 Shore C, or a surface hardness within a range having a lower limit of 75 or 80 or 85 Shore C and an upper limit of 95 Shore C;

(g) a center having a surface hardness greater than or equal to the center hardness of the center;

(h) a center having a positive hardness gradient wherein the surface hardness of the center is at least 10 Shore C units greater than the center hardness of the center;

(i) an outer core layer having a surface hardness greater than or equal to the surface hardness and center hardness of the center;

(j) a core having a positive hardness gradient wherein the surface hardness of the outer core layer is at least 20 Shore C units greater, or at least 25 Shore C units greater, or at least 30 Shore C units greater, than the center hardness of the center;

(k) a center having a compression of 40 or less; and (l) a center having a compression of from 20 to 40.

The weight distribution of cores disclosed herein can be varied to achieve certain desired parameters, such as spin rate, compression, and initial velocity.

Golf ball cores of the present invention typically have an overall core compression of less than 100, or a compression of 87 or less, or an overall core compression within a range having a lower limit of 20 or 50 or 60 or 65 or 70 or 75 and an upper limit of 80 or 85 or 90 or 100 or 110 or 120, or an overall core compression of about 80. Compression is an important factor in golf ball design. For example, the compression of the core can affect the ball's spin rate off the driver and the feel.

Golf ball cores of the present invention typically have a coefficient of restitution ("COR") at 125 ft/s of at least 0.75, preferably at least 0.78, and more preferably at least 0.79. Cores of the present invention are enclosed with a cover, which may be a single-, dual-, or multi-layer cover. The cover may for example have a single layer with a surface hardness of 65 Shore D or less, or 60 Shore D or less, or 45 Shore D or less, or 40 Shore D or less, or from 25 Shore D to 40 Shore D, or from 30 Shore D to 40 Shore D and a thickness within a range having a lower limit of 0.010 or 0.015 or 0.020 or 0.025 or 0.030 or 0.055 or 0.060 inches and an upper limit of 0.065 or 0.080 or 0.090 or 0.100 or 0.110 or 0.120 or 0.140 inches. The flexural modulus of the cover, as measured by ASTM D6272-98 Procedure B, is preferably 500 psi or greater, or from 500 psi to 150,000 psi.

In another embodiment, the cover is a two-layer cover consisting of an inner cover layer and an outer cover layer. The inner cover layer may for example have has a surface hardness of 60 Shore D or greater, or 65 Shore D or greater, or a surface hardness within a range having a lower limit of 30 or 40 or 55 or 60 or 65 Shore D and an upper limit of 66 or 68 or 70 or 75 Shore D, and a thickness within a range having a lower limit of 0.010 or 0.015 or 0.020 or 0.030 inches and an upper limit of 0.035 or 0.040 or 0.045 or 0.050 or 0.055 or 0.075 or 0.080 or 0.100 or 0.110 or 0.120 inches. The inner cover layer composition preferably has a material hardness of 95 Shore C or less, or less than 95 Shore C, or 92 Shore C or less, or 90 Shore C or less, or has a material hardness within a range having a lower limit of 70 or 75 or 80 or 84 or 85 Shore C and an upper limit of 90 or 92 or 95 Shore C. The outer cover layer material can be thermosetting, or thermoplastic. The outer cover layer composition preferably has a material hardness of 85 Shore C or less, or 45 Shore D or less, or 40 Shore D or less, or from 25 Shore D to 40 Shore D, or from 30 Shore D to 40 Shore D. The outer cover layer preferably has a surface hardness within a range having a lower limit of 20 or 30 or 35 or 40 Shore D and an upper limit of 52 or 58 or 60 or 65 or 70 or 72 or 75 Shore D. The outer cover layer preferably has a thickness within a range having a lower limit of 0.010 or 0.015 or 0.025 inches and an upper limit of 0.035 or 0.040 or 0.045 or 0.050 or 0.055 or 0.075 or 0.080 or 0.115 inches. The two-layer cover preferably has an overall thickness within a range having a lower limit of 0.010 or 0.015 or 0.020 or 0.025 or 0.030 or 0.055 or 0.060 inches and an upper limit of 0.065 or 0.075 or 0.080 or 0.090 or 0.100 or 0.110 or 0.120 or 0.140 inches.

In another embodiment, the cover is a dual-layer cover comprising an inner cover layer and an outer cover layer. In a particular aspect of this embodiment, the surface hardness of the outer core layer is greater than the material hardness of the inner cover layer. In another particular aspect of this embodiment, the surface hardness of the outer core layer is greater than both the inner cover layer and the outer cover layer. The inner cover layer preferably has a material hardness of 95 Shore C or less, or less than 95 Shore C, or 92 Shore C or less, or 90 Shore C or less, or has a material hardness within a range having a lower limit of 70 or 75 or 80 or 84 or 85 Shore C and an upper limit of 90 or 92 or 95 Shore C. The thickness of the inner cover layer is preferably within a range having a lower limit of 0.010 or 0.015 or 0.020 or 0.030 inches and an upper limit of 0.035 or 0.045 or 0.080 or 0.120 inches. The outer cover layer preferably has a material hardness of 85 Shore C or less. The thickness of the outer cover layer is preferably within a range having a lower limit of 0.010 or 0.015 or 0.025 inches and an upper limit of 0.035 or 0.040 or 0.055 or 0.080 inches.

A moisture vapor barrier layer is optionally employed between the core and the cover. Moisture vapor barrier layers are further disclosed, for example, in U.S. Pat. Nos. 6,632,147, 6,932,720, 7,004,854, and 7,182,702, the entire disclosures of which are hereby incorporated herein by reference.

Golf balls of the present invention typically have a compression of 120 or less, or a compression within a range having a lower limit of 40 or 50 or 60 or 65 or 75 or 80 or 90 and an upper limit of 95 or 100 or 105 or 110 or 115 or 120. Golf balls of the present invention typically have a COR at 125 ft/s of at least 0.70, preferably at least 0.75, more preferably at least 0.78, and even more preferably at least 0.79.

Golf balls of the present invention will typically have dimple coverage of 60% or greater, preferably 65% or greater, and more preferably 75% or greater. The United States Golf Association specifications limit the minimum size of a competition golf ball to 1.680 inches. There is no specification as to the maximum diameter, and golf balls of any size can be used for recreational play. Golf balls of the present invention can have an overall diameter of any size. The preferred diameter of the present golf balls is from 1.680 inches to 1.800 inches. More preferably, the present golf balls have an overall diameter of from 1.680 inches to 1.760 inches, and even more preferably from 1.680 inches to 1.740 inches.

Golf balls of the present invention preferably have a moment of inertia ("MOI") of 70-95 $g \cdot cm^2$, preferably 75-93 $g \cdot cm^2$, and more preferably 76-90 $g \cdot cm^2$. For low MOI embodiments, the golf ball preferably has an MOI of 85 $g \cdot cm^2$ or less, or 83 $g \cdot cm^2$ or less. For high MOI embodiment, the golf ball preferably has an MOI of 86 $g \cdot cm^2$ or greater, or 87 $g \cdot cm^2$ or greater. MOI is measured on a model MOI-005-104 Moment of Inertia Instrument manufactured by Inertia Dynamics of Collinsville, Conn. The instrument is connected to a PC for communication via a COMM port and is driven by MOI Instrument Software version #1.2.

Thermoplastic layers herein may be treated in such a manner as to create a positive or negative hardness gradient. In golf ball layers of the present invention wherein a thermosetting rubber is used, gradient-producing processes and/or gradient-producing rubber formulation may be employed. Gradient-producing processes and formulations are disclosed more fully, for example, in U.S. patent application Ser. No. 12/048,665, filed on Mar. 14, 2008; Ser. No. 11/829,461, filed on Jul. 27, 2007; Ser. No. 11/772,903, filed Jul. 3, 2007; Ser. No. 11/832,163, filed Aug. 1, 2007; Ser. No. 11/832,197, filed on Aug. 1, 2007; the entire disclosure of each of these references is hereby incorporated herein by reference.

In connection with the many different constructions that are envisioned as being suitable for a golf ball of the invention, one or more of the following test methods may be applied:

Hardness

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within 0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The outer surface hardness of a golf ball layer is measured on the actual outer surface of the layer and is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to ensure that the golf ball or golf ball subassembly is centered under the durometer indenter before a surface hardness reading is obtained. A calibrated, digital durometer, capable of reading to 0.1 hardness units is used for the hardness measurements. The digital durometer must be attached to, and its foot made parallel to, the base of an automatic stand. The weight on the durometer and attack rate conforms to ASTM D-2240.

In certain embodiments, a point or plurality of points measured along the "positive" or "negative" gradients may be above or below a line fit through the gradient and its outermost and innermost hardness values. In an alternative preferred embodiment, the hardest point along a particular steep "positive" or "negative" gradient may be higher than the value at the innermost portion of the inner core (the geometric center) or outer core layer (the inner surface)—as long as the outermost point (i.e., the outer surface of the inner core) is greater than (for "positive") or lower than (for "negative") the innermost point (i.e., the geometric center of the inner core or the inner surface of the outer core layer), such that the "positive" and "negative" gradients remain intact.

As discussed above, the direction of the hardness gradient of a golf ball layer is defined by the difference in hardness measurements taken at the outer and inner surfaces of a particular layer. The center hardness of an inner core and hardness of the outer surface of an inner core in a single-core ball or outer core layer are readily determined according to the test procedures provided above. The outer surface of the inner core layer (or other optional intermediate core layers) in a dual-core ball are also readily determined according to the procedures given herein for measuring the outer surface hardness of a golf ball layer, if the measurement is made prior to surrounding the layer with an additional core layer. Once an additional core layer surrounds a layer of interest, the hardness of the inner and outer surfaces of any inner or intermediate layers can be difficult to determine. Therefore, for purposes of the present invention, when the hardness of the inner or outer surface of a core layer is needed after the inner layer has been surrounded with another core layer, the test procedure described above for measuring a point located 1 mm from an interface is used.

Also, it should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other. Shore hardness (for example, Shore C or Shore D hardness) was measured according to the test method ASTM D-2240.

Compression

As disclosed in Jeff Dalton's Compression by Any Other Name, Science and Golf IV, Proceedings of the World Scientific Congress of Golf (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 42.7 mm (1.68 inches); thus, smaller objects, such as golf ball cores, must be shimmed to a total height of 42.7 mm to obtain an accurate reading. Conversion from Atti compression to Riehle (cores), Riehle (balls), 100 kg deflection, 130-10 kg deflection or effective modulus can be carried out according to the formulas given in J. Dalton. Compression may be measured as described in McNamara et al., U.S. Pat. No. 7,777,871, the disclosure of which is hereby incorporated by reference.

Coefficient of Restitution ("CoR")

The CoR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. The CoR is then calculated as the ratio of the ball's outgoing transit time period to the ball's incoming transit time period ($CoR=V_{out}/V_{in}=T_{in}/T_{out}$).

Moisture Transmission Rate

As used herein, the term "moisture vapor transmission rate" is defined as the mass of moisture vapor that diffuses into a material of a given thickness per unit area per unit time. The preferred standards of measuring the moisture vapor transmission rate include ASTM F1249-90 entitled "Standard Test Method for Water Vapor Transmission Rate Through Plastic Film and Sheeting Using a Modulated Infrared Sensor," and ASTM F372-94 entitled "Standard Test Method for Water Vapor Transmission Rate of Flexible Barrier Materials Using an Infrared Detection Technique," among others.

Additional Examples of Suitable Golf Ball Manufacturing Methods/Processes

Golf balls of the invention may be formed using a variety of conventional application techniques such as compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials. These and other manufacture methods are disclosed in U.S. Pat. Nos. 6,207,784 and 5,484,870, the disclosures of which are incorporated herein by reference in their entireties.

A method of injection molding using a split vent pin can be found in co-pending U.S. Pat. No. 6,877,974, filed Dec. 22, 2000, entitled "Split Vent Pin for Injection Molding." Examples of retractable pin injection molding may be found in U.S. Pat. Nos. 6,129,881; 6,235,230; and 6,379,138. These molding references are incorporated in their entirety by reference herein. In addition, a chilled chamber, i.e., a cooling jacket, such as the one disclosed in U.S. Pat. No. 6,936,205, filed Nov. 22, 2000, entitled "Method of Making Golf Balls" may be used to cool the compositions of the invention when casting, which also allows for a higher loading of catalyst into the system.

Conventionally, compression molding and injection molding are applied to thermoplastic materials, whereas RIM, liquid injection molding, and casting are employed on thermoset materials. These and other manufacture methods are disclosed in U.S. Pat. Nos. 6,207,784 and 5,484,870, the disclosures of which are incorporated herein by reference in their entirety.

Castable reactive liquid polyurethanes and polyurea materials may be applied over the inner ball using a variety of application techniques such as casting, injection molding spraying, compression molding, dipping, spin coating, or flow coating methods that are well known in the art. In one embodiment, the castable reactive polyurethanes and polyurea material is formed over the core using a combination of casting and compression molding. Conventionally, compression molding and injection molding are applied to thermoplastic cover materials, whereas RIM, liquid injection molding, and casting are employed on thermoset cover materials.

U.S. Pat. No. 5,733,428, the entire disclosure of which is hereby incorporated by reference, discloses a method for forming a polyurethane cover on a golf ball core. Because this method relates to the use of both casting thermosetting and thermoplastic material as the golf ball cover, wherein the cover is formed around the core by mixing and introducing the material in mold halves, the polyurea compositions may also be used employing the same casting process.

For example, once a polyurea composition is mixed, an exothermic reaction commences and continues until the material is solidified around the core. It is important that the viscosity be measured over time, so that the subsequent steps of filling each mold half, introducing the core into one half and closing the mold can be properly timed for accomplishing centering of the core cover halves fusion and achieving overall uniformity. A suitable viscosity range of the curing urea mix for introducing cores into the mold halves is determined to be approximately between about 2,000 cP and about 30,000 cP, or within a range of about 8,000 cP to about 15,000 cP.

To start the cover formation, mixing of the prepolymer and curative is accomplished in a motorized mixer inside a mixing head by feeding through lines metered amounts of curative and prepolymer. Top preheated mold halves are filled and placed in fixture units using centering pins moving into apertures in each mold. At a later time, the cavity of a bottom mold half, or the cavities of a series of bottom mold halves, is filled with similar mixture amounts as used for the top mold halves. After the reacting materials have resided in top mold halves for about 40 to about 100 seconds, preferably for about 70 to about 80 seconds, a core is lowered at a controlled speed into the gelling reacting mixture.

A ball cup holds the shell through reduced pressure (or partial vacuum). Upon location of the core in the halves of the mold after gelling for about 4 to about 12 seconds, the vacuum is released allowing the core to be released. In one embodiment, the vacuum is released allowing the core to be released after about 5 seconds to 10 seconds. The mold halves, with core and solidified cover half thereon, are removed from the centering fixture unit, inverted and mated with second mold halves which, at an appropriate time earlier, have had a selected quantity of reacting polyurea prepolymer and curing agent introduced therein to commence gelling.

Similarly, U.S. Pat. No. 5,006,297 and U.S. Pat. No. 5,334,673 both also disclose suitable molding techniques that may be utilized to apply the castable reactive liquids employed in the present invention.

However, golf balls of the invention may be made by any known technique to those skilled in the art.

It is contemplated that "indicia" may be incorporated in golf balls of the invention. The term "indicia" is considered to mean any symbol, letter, group of letters, design, or the like, that can be added to a layer or surface of the golf ball.

It will be appreciated that any known dimple pattern may be used with any number of dimples having any shape or size, width, depth, and edge angle. The parting line configuration of said pattern may be either a straight line or a staggered wave parting line (SWPL).

In any of these embodiments the single-layer core may be replaced with a 2 or more layer core wherein at least one core layer has a hardness gradient. A hardness gradient may exist within and/or between golf ball layers.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

All patents, publications, test procedures, and other references cited herein, including priority documents, are fully incorporated by reference to the extent such disclosure is not inconsistent with this invention and for all jurisdictions in which such incorporation is permitted.

It is understood that the compositions and golf ball products described and illustrated herein represent only some embodiments of the invention. It is appreciated by those skilled in the art that various changes and additions can be made to compositions and products without departing from the spirit and scope of this invention. It is intended that all such embodiments be covered by the appended claims.

What is claimed is:

1. A golf ball comprising at least one layer consisting of a color-stable composition comprising a color concentrate composition comprising (i) a carrier resin; (ii) at least one pigment that does not contain any highly crosslinked thermoset fluorescent microspheres; and (iii) a plurality of highly crosslinked thermoset fluorescent microspheres;

wherein the plurality of highly crosslinked thermoset fluorescent microspheres has a predominant hue in the CIELAB color space that is the same as a hue created in the CIELAB color space by the at least one pigment that does not contain any highly crosslinked thermoset fluorescent microspheres;

wherein each highly crosslinked thermoset fluorescent microsphere is substantially spherical;

wherein each highly crosslinked thermoset fluorescent microsphere has a diameter of from about 0.5 micron to about 2.0 microns;

wherein the carrier resin is an ionomer; and wherein the ratio of parts by weight of carrier resin to parts by weight of plurality of highly crosslinked thermoset fluorescent microspheres is about 1.0:0.20 to 1.0:3.5.

2. The golf ball of claim 1, wherein the pigment that does not contain any highly crosslinked thermoset fluorescent microspheres includes titanium dioxide and has a hue other than white.

3. The golf ball of claim 2, wherein the ratio of parts by weight of pigment not containing any highly crosslinked thermoset fluorescent microspheres to parts by weight of plurality of highly crosslinked thermoset fluorescent microspheres is about 1.0:0.5 to 1.0:2.0.

4. The golf ball of claim 3, wherein the color-stable composition comprises a mixture of the color concentrate composition and a polymer composition.

5. The golf ball of claim 4, wherein the polymer composition is an ionomer composition.

6. The golf ball of claim 5, wherein the mixture comprises about 95 to 98 parts by weight of a blend of the carrier resin and the ionomer composition, about 0.2 to 1.0 parts by weight of at least one backer pigment, and about 0.1 to 2.0 parts by weight of plurality of highly crosslinked thermoset fluorescent microspheres, based on the total weight of the color-stable composition.

7. The golf ball of claim 6, wherein the mixture further comprises about 0.1 to 1.0 parts by weight of at least one ultra violet (UV) absorber, about 0.1 to 1.0 parts by weight of at least one hindered amine light stabilizer (HALS), or a combination thereof.

8. The golf ball of claim 7, wherein the at least one UV absorber selected from the group consisting of triazines, benzoxazinones, benzotriazoles, benzophenones, benzoates, formamidines, cinnamates/propenoates, aromatic propanediones, benzimidazoles, cycloaliphatic ketones, formanilides (including oxamides), cyanoacrylates, benzopyranones, salicylates, substituted acrylonitriles, or combinations thereof.

9. The golf ball of claim 7, wherein the at least one HALS is a derivative of 2,2,6,6-tetraamethylpiperidine.

10. The golf ball of claim 7, wherein the at least one layer is a cover layer having a thickness of from about 0.030 inches to about 0.085 inches disposed about a polybutadiene-based core having a diameter of from about 1.5 inches to about 1.620 inches.

11. A method of making a golf ball comprising:

providing a subassembly;

providing a color-stable composition comprising a color concentrate composition comprising (i) a carrier resin, (ii) at least one pigment not containing any highly crosslinked thermoset fluorescent microspheres, and (iii) a plurality of highly crosslinked thermoset fluorescent microspheres;

wherein the plurality of highly crosslinked thermoset fluorescent microspheres has a predominant hue in the CIELAB color space that is the same as a hue created in the CIELAB color space by the at least one pigment that does not contain any highly crosslinked thermoset fluorescent microspheres; and forming at least one layer consisting of the color-stable composition about the subassembly;

wherein each highly crosslinked thermoset fluorescent microsphere is substantially spherical;

wherein each highly crosslinked thermoset fluorescent microsphere has a diameter of from about 0.5 micron to about 2.0 microns;

wherein the carrier resin is an ionomer; and wherein the ratio of parts by weight of carrier resin to parts by weight of plurality of highly crosslinked thermoset fluorescent microspheres is about 1.0:0.20 to 1.0:3.5.

12. The method of claim 11, wherein the pigment that does not contain any highly crosslinked thermoset fluorescent microspheres includes titanium dioxide and has a hue other than white.

13. The method of claim 12, wherein the ratio of parts by weight of pigment that does not contain any highly crosslinked thermoset fluorescent microspheres to parts by weight of plurality of highly crosslinked thermoset fluorescent microspheres is about 1.0:0.5 to 1.0:2.0.

14. The golf ball of claim 13, wherein the color-stable composition comprises a mixture of the color concentrate composition and an ionomer composition.

15. The method of claim 14, wherein the mixture comprises about 95 to 98 parts by weight of an ionomer blend of the carrier resin and the ionomer composition, about 0.2 to 1.0 parts by weight of at least one backer pigment, and about 0.1 to 2.0 parts by weight of plurality of highly crosslinked thermoset fluorescent microspheres, based on the total weight of the color-stable composition.

16. The method of claim 15, wherein the mixture further comprises about 0.1 to 1.0 parts by weight of at least one ultra violet (UV) absorber, about 0.1 to 1.0 parts by weight of at least one hindered amine light stabilizer (HALS), or a combination thereof.

17. The method of claim 16, wherein at least one UV absorber is selected from the group consisting of triazines, benzoxazinones, benzotriazoles, benzophenones, benzoates, formamidines, cinnamates/propenoates, aromatic propanediones, benzimidazoles, cycloaliphatic ketones, formanilides (including oxamides), cyanoacrylates, benzopyranones, salicylates, substituted acrylonitriles, or combinations thereof.

18. The method of claim 16, wherein at least one HALS is a derivative of 2,2,6,6-tetraamethylpiperidine.

19. The method of claim 16, wherein the at least one layer is a cover layer disposed about a polybutadiene-based core.

* * * * *